US005542788A

United States Patent [19]

Stankus et al.

[11] Patent Number: 5,542,788

[45] Date of Patent: Aug. 6, 1996

[54] METHOD AND APPARATUS FOR MONITORING MINE ROOF SUPPORT SYSTEMS

[75] Inventors: John C. Stankus, Canonsburg, Pa.; Song Guo, Morgantown, W. Va.

[73] Assignee: Jennmar Corporation, Pittsburgh, Pa.

[21] Appl. No.: 432,896

[22] Filed: May 2, 1995

Related U.S. Application Data

[63] Continuation-in-part of Ser. No. 151,791, Nov. 12, 1993, Pat. No. 5,425,601.

[51] Int. Cl.[6] ..... E21D 21/00

[52] U.S. Cl. ..... 405/288; 33/1 H; 73/761; 73/784; 340/690; 405/259.1

[58] Field of Search ..... 405/259.1, 288, 405/290, 302; 411/12, 54; 73/784, 761, 786, 778, 785, DIG. 1, 597; 364/468, 469; 33/783, 1 H; 340/690

[56] References Cited

U.S. PATENT DOCUMENTS

| | | | |
|---|---|---|---|
| 3,594,773 | 7/1971 | Conkle | 340/282 |
| 3,600,938 | 8/1971 | Waddell | 73/88 E |
| 3,872,719 | 3/1975 | Beus et al. | 73/761 |
| 3,914,992 | 10/1975 | Babcock | 73/778 |
| 3,960,009 | 6/1976 | Roepke et al. | 73/784 X |
| 4,047,463 | 9/1977 | Coldren | 411/12 |
| 4,066,992 | 1/1978 | Buller et al. | 299/12 |
| 4,070,906 | 1/1978 | Rupert et al. | 33/700 |
| 4,136,556 | 1/1979 | Graham | 340/690 |
| 4,183,585 | 1/1980 | Brennan | 299/43 |
| 4,453,846 | 6/1984 | Mullins et al. | 405/299 |
| 4,514,905 | 5/1985 | Lutzens . | |
| 4,581,712 | 4/1986 | Perry et al. | 364/558 |
| 4,601,616 | 7/1986 | Barish et al. | 405/288 |
| 4,776,729 | 10/1988 | Seegmiller | 405/288 |
| 4,865,489 | 9/1989 | Stankus et al. | 405/261 |
| 4,887,935 | 12/1989 | Koppers et al. | 405/302 |
| 4,913,499 | 4/1990 | Smart | 299/12 |
| 4,934,873 | 6/1990 | Calandra, Jr. | 405/288 |
| 4,946,315 | 8/1990 | Chugh et al. | 405/288 |
| 5,029,943 | 7/1991 | Merriman | 299/1 |
| 5,176,473 | 1/1993 | Seegmiller | 405/288 |
| 5,205,176 | 4/1993 | Kibblewhite | 73/761 |
| 5,244,314 | 9/1993 | Calandra, Jr. et al. | 405/259.4 |
| 5,292,209 | 3/1994 | Calandra, Jr. et al. | 405/302.1 |
| 5,302,056 | 4/1994 | Calandra, Jr. et al. | 405/288 |

FOREIGN PATENT DOCUMENTS

| | | | |
|---|---|---|---|
| 619297 | 9/1935 | Germany | 405/288 |
| 001816860 | 5/1993 | Russian Federation | 299/1.05 |
| 001686161 | 10/1991 | U.S.S.R. | 299/1.05 |

OTHER PUBLICATIONS

"Evaluation of Cable Bolt Supports at the Homestake Mine" by J. M. Goris, F. Duan, and J. Pfarr, Mar. 1991. *CIM Bulletin,* vol. 84. No. 947, pp. 146–150.

"Mettiki Overcomes Abutment Pressures", by Thomas M. Wynne, John C. Stankus and Syd S. Peng, May 1993, *COAL, A Maclean Hunter Publication, Longwall USA,* 6 pp.

"Design And Implementation Of Roof Control Systems For A Longwall Full Face Recovery Room And Chutes At Mettiki Mine", by Thomas M. Wynne, John C. Stankus and Syd S. Peng, Longwall USA, *International Exhibition & Conference, Conference Papers,* Pittsburgh, Pennsylvania, Jun. 8–10, 1993, pp. 148–158.

*Primary Examiner*—Dennis L. Taylor

*Attorney, Agent, or Firm*—Webb Ziesenheim Bruening Logsdon Orkin & Hanson, P.C.

[57] ABSTRACT

In a longwall mining operation, a panel to be extracted is formed in a seam of mine material by longitudinally extending headgate and tailgate entries with the panel beginning in a set-up room and ending at a termination line in a recovery room. The recovery room is developed in two stages and is supported by primary and secondary roof support systems that include mechanical roof bolt assemblies, roof trusses, and channel members. The effectiveness of the roof support systems to support the overlying rock strata and withstand the abutment pressure exerted on the strata by the advancing longwall face as it approaches the recovery room is monitored by an instrumentation plan. Data gathered from the instruments is continually monitored as the longwall panel recovery operation progresses.

4 Claims, 14 Drawing Sheets

LONGWALL RECOVERY CHUTE

METHOD AND APPARATUS FOR MONITORING MINE ROOF SUPPORT SYSTEMS

CROSS-REFERENCE TO RELATED APPLICATION

This application is a continuation-in-part of application Ser. No. 08/151,791 filed Nov. 12, 1993 entitled "Longwall Mining Roof Control System", now U.S. Pat. No. 5,425,601.

BACKGROUND OF THE INVENTION

1. Field of the Invention

This invention relates to a method and apparatus for measuring the effectiveness of support systems used to reinforce an underground excavation and, more particularly, to a system for monitoring the roof control system utilized in a longwall mining operation.

2. Description of the Prior Art

In underground mining, excavation and tunneling operations, it is conventional practice to reinforce the exposed overhead and lateral rock strata by support systems. The support systems may include conventional wood timbering, cribs, and concrete cribs. Elongated anchor bolts are inserted in bore holes drilled in the exposed rock strata. The anchor bolts are anchored in the bore holes by mechanical expansion shells, resin, or a combination of both, as illustrated in U.S. Pat. No. 4,865,489, and are tensioned to compress a bearing plate against the rock strata. Anchor bolts are also used to secure metal roof mats and channels across a mine roof and downwardly along the lateral sidewalls or ribs of an entry. The mats and channels are provided in various lengths with holes spaced a preselected distance apart through which roof bolts extend and are anchored in the strata to maintain the channels compressed against the surface of the rock strata.

Another known underground support system is the truss-type support, as disclosed in U.S. Pat. Nos. 4,601,616 and 4,934,873, which includes one or more rods connected and extending horizontally the width of a mine passageway. The rods are connected at their ends to anchor bolts which extend at an angle adjacent the ribs of the passageway into the rock strata over a solid pillar. The rods are tensioned so that the vertical components of the compressive forces are transmitted into the solid material over the pillars.

In underground mining operations, a wide variety of roof support requirements are encountered necessitating the use of many of the above-described support systems. In some applications, wood timbering and cribbing are cost effective and provide adequate support. In other applications, mechanical and resin bonded roof bolts are used primarily because of their ease of installation, cost effectiveness and superior anchorage. In certain applications, the use of channels and mats is preferred. In conditions where roof bolts and/or channels and mats are not totally effective, the truss-type roof supports are commonly used.

A longwall mining operation is an example of an underground mining system in which a wide variety of devices are used to reinforce the excavated areas beneath the rock strata. In a conventional longwall mining operation, a panel is developed for extraction or recovery of the mine material. The panel typically has a transverse dimension of 600 to 800 feet formed by parallel spaced headgate and tailgate entries extending a considerable distance, for example 4,000 to 10,000 feet, into the seam of mine material.

The panel is initially formed using a continuous mining machine. The longitudinally extending entryways include at one side the tailgate entry and at the opposite side the headgate entry. The tailgate entry is used for ventilation purposes and also serves as a main escapeway for personnel working at or near the longwall face. Also in the event of an emergency occurring on the headgate side of the longwall panel, an escape route is provided off the longwall face through the tailgate entry to a main entry.

The headgate entry is also used to promote face ventilation and to convey the dislodged material from the working face to a series of sub-main entries where conveyors transport the mined material out of the mine. The headgate and tailgate entries are also accessed transversely for the movement of personnel and equipment to and from the longwall face from other longitudinally extending entries by cross cut or bleeder entries. Bleeder entries connect with the headgate and tailgate entries and serve to provide airflow to ventilate these areas and remove methane gas from the mine face.

At opposite transverse ends of the panel are located the set-up room and the recovery room. The longwall shearers, shield supports and pan line are assembled in the set-up room. In operation, the shearers transverse the panel face beneath the shield supports between the headgate and the tailgate entries. The dislodged material is conveyed by the pan line laterally to the headgate entry and therefrom out of the mine. The longwall mining operation continues until the shearers break through the panel into the recovery room.

When the longwall operation reaches the recovery room, the shearers, shield supports, and pan line are disassembled. The recovery room is connected to adjacent entries by recovery chutes and cross cuts leaving solid pillars in place to support the overhead structure. The disassembled shearers and pan line and retracted shield supports are moved out of the recovery room through the recovery chutes. The longwall shield supports are lowered from contact with the mine roof and advanced from the recovery room to the next location where the longwall mining machine is set up for extracting another panel.

The various excavated sections of a longwall mining operation require different types of roof supports. In certain entries, a primary system of mechanical roof bolts provides adequate overhead support; while, in other areas mats and channels are preferred. Certain roof conditions may require the utilization of a combination of mechanically anchored roof bolts and a truss system. Therefore, in a longwall mining operation particular attention must be given to the type of roof support used in the headgate entry, tailgate entry, set-up room, recovery room and access chutes to and, from the set-up and recovery rooms. It is important that the roof control system be installed so as to provide a safe working environment for personnel and equipment .and prevent interruption in the mining operation due to roof falls and pillar failures.

In a longwall mining operation, the recovery or teardown room is developed before the panel is extracted. This requires that the rock strata above the roof of the recovery room be supported to withstand the abutment pressures that are applied thereto when the longwall mining machine has advanced the panel closely adjacent to where it breaks through into the recovery room. The conventional method of supporting the roof of a recovery room includes cribbing, generally fabricated of wood or concrete, positioned adjacent to the wall of the recovery room where the longwall shearers break through and also adjacent the outby wall of the recovery room.

The span of the roof of the recovery room between the cribbing is conventionally supported by roof bolts. It is also known to use wire rope trusses and wire screening to support the mine roof to withstand the abutment pressures that are generated as the longwall shearers approach the termination line of the panel before the breakthrough into the recovery room. Even with these measures taken to support the mine roof, the abutment pressures can build to a magnitude causing failure of the pillar of material between the longwall shield supports and the recovery room before the shearers cut through the termination line into the recovery room.

When the roof immediately in front of the shield supports fails before the longwall shearers reach the recovery room, substantial delays in the mining operation are encountered. The material from the roof fall must be removed and thereafter the exposed roof must be reinforced before the shearers can be advanced into the recovery room. Various methods have been proposed to provide additional reinforcement of the roof above the recovery room to resist the abutment pressures generated by the advancing longwall so that the pressures are dissipated over the recovery room to the surrounding solid pillars. However, present methods, such as injecting polyurethane glue into the immediate roof in advance of the shield supports, constitute a substantial material cost and require interruption of the mining process to allow the glue to set, resulting in an .expensive loss of production. Installing wire meshing and bolting the exposed roof immediately in advance of the shield supports have not proved adequate to eliminate the exposure of hazardous conditions to personnel working beneath the roof in advance of the longwall shield supports. Furthermore, installation of wire meshing and roof bolts in advance of the shield supports near the termination line causes substantial delays in the longwall advance rate.

It is well known to monitor the behavior of rock strata surrounding an excavated area during a mining operation as disclosed in U.S. Pat. Nos. 3,600,938 and 4,136,556. U.S. Pat. Nos. 3,594,773 and 4,514,905 disclose extensometers extending between the mine roof and floor for measuring the roof to floor convergence. In the event the mine roof subsides a predetermined distance along the vertical, a signal is generated to warn of a danger of roof collapse. U.S. Pat. No. 4,913,499 discloses a convergence measuring device positioned on a longwall roof support.

U.S. Pat. No. 4,581,712 discloses a system for measuring and monitoring the stress levels applied to mine roof bolts and support columns. Sensors are positioned between the mine roof and portions of the roof bolts or support columns. The sensors are electrically connected to modules which transmit signals to a host computer when a sufficient change is detected in the load applied by the overhead rock strata to the roof bolt. In this manner, a detection in the change of the load on the roof bolt provides a warning of a possible cave-in or roof-fall.

The use of extensometers and strain gages to analyze rock mass behavior is discussed in the article entitled "Evaluation of Cable Bolt Supports at the Homestake Mine" by J. M. Goris, F. Duan, and J. Pfarr, published in the March 1991 issue of *CIM Bulletin*. These instruments were used to determine the effectiveness of cable bolts for supporting rock masses during the mining operation. The extensometers were grouted into holes positioned adjacent to cable bolts installed in a preselected bolt pattern to support the rock masses. Strain gages were attached to the cable bolts. Data from the instruments provided an indication of the effectiveness of cable bolts to support the rock masses.

It is also known, as disclosed in U.S. Pat. Nos. 4,453,846; 4,887,935; and 5,029,943, to monitor and collect data transmitted from longwall roof supports relating to the operation of the roof supports.

While it is known to use measuring devices in an underground mine to monitor the stability of rock formations reinforced by roof support devices and to monitor the movement of mining equipment in the mine, there is a need for an instrumentation plan that monitors the effectiveness of a roof support system installed throughout a longwall mine. Such an instrumentation plan must be capable of recording the load pressures exerted on the roof support device as the longwall mining operation progresses in order to identify the areas of maximum pressure in the mining operation.

SUMMARY OF THE INVENTION

In accordance with the present invention there is provided an apparatus for measuring the effectiveness of roof support devices installed in an excavated area beneath underground rock strata that includes a primary system of roof bolt assemblies installed in the rock strata above the roof in accordance with a preselected bolt pattern extending between opposed sidewalls of the excavated area. A secondary system of roof truss assemblies extends between the opposed sidewalls. Each of the roof truss assemblies is positioned in spaced parallel relation a preselected distance apart and in a selected position with respect to the roof bolt assemblies. Anchor means extend upwardly at an angle through the roof into the rock strata above the opposed sidewalls for securing the roof truss assemblies to the rock strata to place the roof truss assembly in tension and support the rock strata above the roof. A plurality of spaced apart, longitudinally extending channels is positioned between and parallel to the opposed sidewalls. Instrumentation means is installed in the rock strata surrounding the excavated area and connected to the primary system of roof bolt assemblies and the secondary system of roof truss assemblies for measuring the force exerted by the rock strata on the primary and secondary systems to determine the operability of the systems to support the rock strata. A plurality of longitudinally extending channel members is anchored in parallel relation between the opposed sidewalls to the roof to supplement the roof support provided by the combination of the primary system of roof bolt assemblies and the secondary system of roof truss assemblies.

Further in accordance with the present invention, there is provided a method for monitoring the operability of a roof support system installed to support overhead rock strata in a longwall recovery room that includes the steps of initially forming a recovery room of a preselected width extending from a termination line of a longwall panel of mine material to an outby wall. The roof support devices are installed in the rock strata above the roof of the recovery room. The width of the recovery room is expanded from an outby wall a preselected distance. The roof support devices installed in the rock strata above the roof of the expanded area of the recovery room are coordinated with the roof support devices installed in the initial area of the recovery room to form an enlarged recovery room having a reinforced overhead rock strata. Load sensing instruments are installed in the rock strata surrounding the recovery room and in contact with the roof support devices to measure the forces applied by the rock strata surrounding the recovery room and the load exerted on the roof support devices. The load sensing instruments are monitored to determine the effectiveness of the roof support devices to reinforce the rock strata surrounding the recovery room.

Additionally the present invention is directed to a method for extracting a panel of mine material by a longwall mining operation that includes the steps of cutting a longwall panel in a seam of mine material extending a preselected length into rock strata and extending in width between a headgate entry and a tailgate entry. A set-up room is formed at one transverse end of the panel defining a full face of the panel for initiating the extraction of mine material from the face. Support systems for reinforcing the rock strata are installed above a roof formed in the headgate entry, the tailgate entry, and the set-up room. At the opposite transverse end of the panel a recovery room is formed to extend in length between the headgate and tailgate entries. Initially, the width of the recovery room is extended a preselected distance from a termination line of the panel to an opposite first sidewall of the rock strata. A first support system for reinforcing the rock strata is installed above a roof of the recovery room extending between the panel termination line and the first sidewall. The first support system is extended into the rock strata above the panel termination line to reinforce the rock strata above the termination line. The first sidewall is extracted after installing the first support system in the recovery room to expand the width of the recovery room a preselected distance to a second sidewall to form a resultant recovery room of expanded width. A second support system for reinforcing the rock strata is installed above the roof of the expanded width of the recovery room. The second support system extends into the area of the recovery room roof supported by the first support system to reinforce the mid span of the recovery room roof between the panel termination line and the second sidewall. Load sensing devices are installed in boreholes drilled in the rock strata surrounding the headgate entry, the tailgate entry, the set-up room, and the recovery room. The load sensing devices are installed in contact with the support systems including the first and second support systems. A longwall shearer traverses back and forth across the panel face to extract mine material from the panel and advance the panel face to the panel termination line. The load sensing devices are monitored to obtain a reading of the forces applied thereto by the rock strata to determine the effectiveness of the roof support systems to support the rock strata as the longwall shearer advances through the panel termination line into the recovery room.

Accordingly, a principal object of the present invention is to provide a method and apparatus for monitoring the effectiveness of a roof support system installed to reinforce excavated areas in a longwall mine.

Another object of the present invention is to provide a method and apparatus for analyzing the load pressures exerted by overhead roof strata on a roof support system installed in a longwall mine as the longwall shearers advance through a panel termination line into a recovery room.

A further object of the present invention is to provide an instrumentation plan for monitoring the effectiveness of primary and secondary roof support systems installed in a longwall mine to determine the occurrence of maximum abutment pressures exerted on the mine face as the longwall shearers advance through the panel into the recovery room.

An additional object of the present invention is to provide a method for monitoring the operability of a roof truss system installed to support overhead strata in a longwall mine and control the abutment pressures applied to panels and pillars surrounding the entries formed in the mining operation.

These and other objects of the present invention will be more completely disclosed and described in the following specification, the accompanying drawings and the appended claims.

DESCRIPTION OF THE PREFERRED EMBODIMENTS

Figure 1:
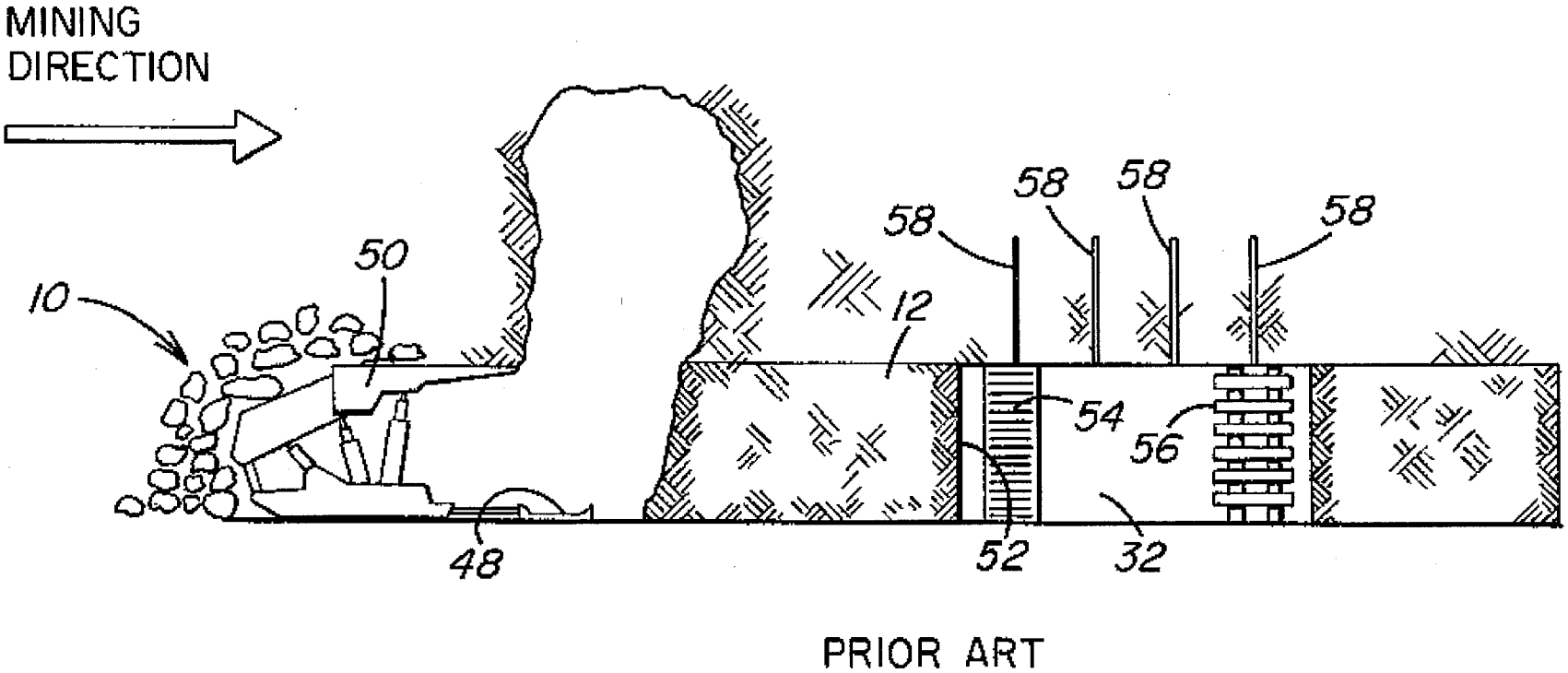
FIG. 1 is a schematic illustration of a longwall mining operation for the extraction of a panel of material where a predeveloped recovery room is positioned behind the panel and is supported by prior art cribbing and mechanical roof bolts, illustrating failure of the roof immediately in front of the shield supports approaching the recovery room.
Figure 2:
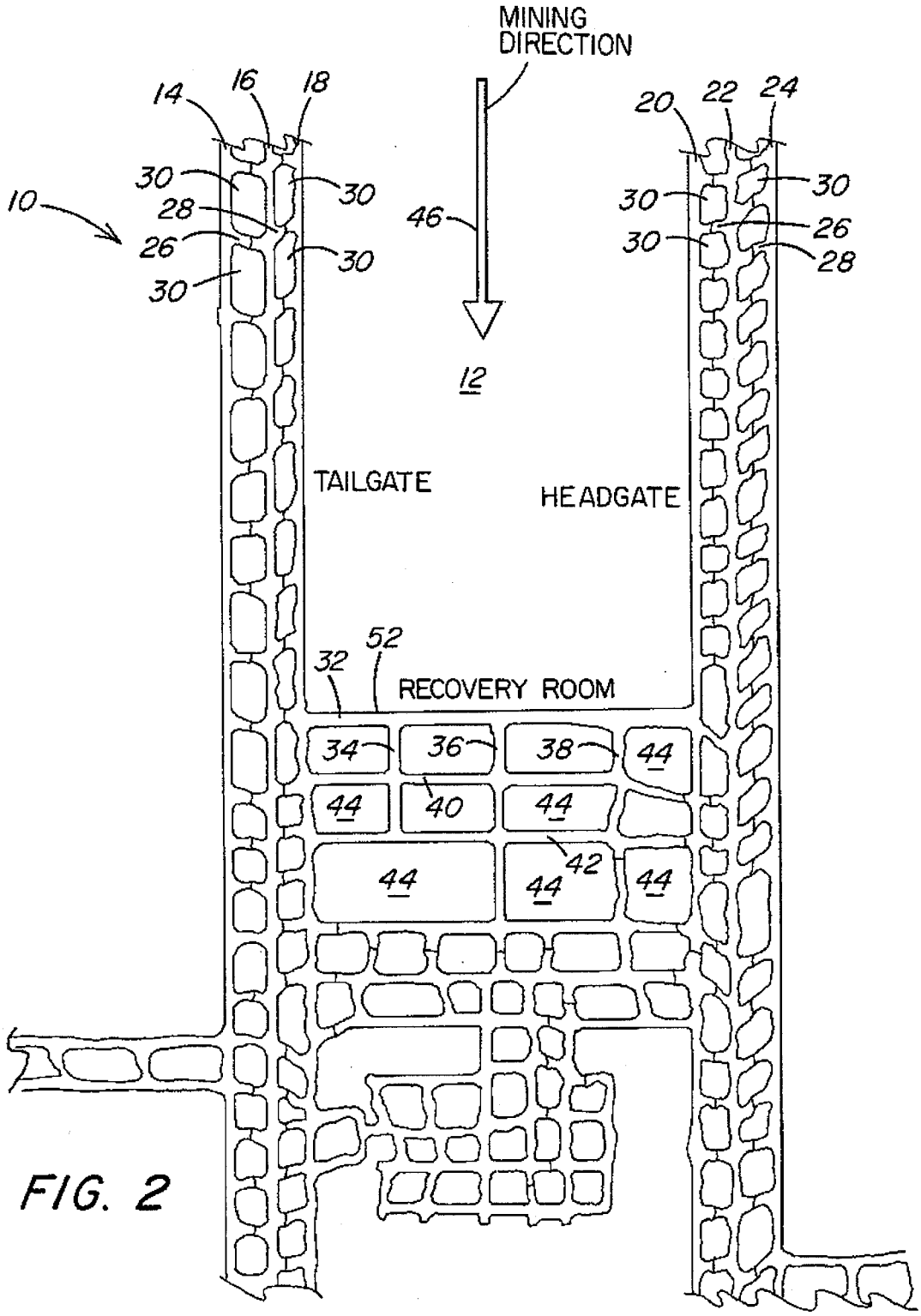
FIG. 2 is a diagrammatic layout of a longwall mining operation, illustrating the direction of advancement of the longwall mining machine through a panel formed by tailgate and headgate entries and the recovery room which is connected to a series of entries and chutes.

Referring to the drawings and particularly to FIGS. 1 and 2 there is illustrated the layout of a longwall mining operation generally designated by the numeral 10. The longwall mining operation is conducted in a conventional manner by first forming a longwall panel 12 containing a seam of mine material to be extracted by a longwall mining machine. A longwall mining machine suitable for use with the present invention is disclosed in U.S. Pat. No. 4,183,585 which is incorporated herein by reference. The panel 12 is first formed by conventional methods such as a single entry mining machine in which a series of substantially parallel entries 14, 16, 18, 20, 22, 24, are driven a selected distance into the rock formation, for example 4,000 to 10,000 feet.

A plurality of bleeder entries, such as entries 26 and 28 shown in FIG. 2, are driven at spaced apart intervals to provide access to tailgate and headgate entries 18 and 20 from the adjacent main entries 14, 16 and 22, 24. The bleeder entries 26 and 28 are separated from one another by solid pillars 30. The tailgate and headgate entries 18 and 20 extend the length of the panel 12. The tailgate and headgate entries 18 and 20 begin at a set-up room (not shown) where the longwall mining machine is initially assembled to extract the panel 12.

At a preselected depth into the seam of mine material a recovery room 32 is cut transversely across the panel 12 to connect the tailgate and headgate entries 18 and 20. From the recovery room 32, recovery chutes 34, 36 and 38 are driven at spaced apart intervals. The chutes 34, 36 and 38, in turn, intersect spaced apart cross entries 40 and 42 which extend transversely between the tailgate and headgate entries 18 and 20. The formation of the chutes 34–38 and cross entries 40 and 42 outline a plurality of pillars 44 that are left in place to provide support of the overhead rock strata.

Before the extraction of the longwall panel 12 is commenced, the longwall layout is developed as illustrated in FIG. 2. The development of the layout includes the installation of a roof support system and an instrument plan for monitoring the effectiveness of the plan to support the rock strata in the various entries and passageways in accordance with the present invention as will be described hereinafter in greater detail.

Once the longwall layout is developed and the roof support systems are installed, the extraction of the panel 12 is commenced in the direction of advancement by the longwall mining machine as indicated by the arrow 46 in FIG. 2. The longwall mining operation is conducted in a conventional manner in which a shearer-type cutting machine as disclosed in U.S. Pat. No. 4,183,585 traverses the panel 12 between the tailgate entry 18 and the headgate entry 20. The material dislodged from the face of the panel 12 is collected by a conveyor 48 that is positioned beneath the rotary cutter drums or shearers (not shown) and extends the width of the panel between the tailgate entry 18 and the headgate entry 20. The rotary cutter drums and the conveyor are protected by overhead shield supports 50, as schematically illustrated in FIG. 1.

The shield supports 50 are raised and lowered into and out of contact with the mine roof by operation of hydraulic props. The shield supports are raised to engage the mine roof in side by side relation the full width of the panel 12 to support the mine roof immediately above the conveyor and shearers. As the panel is extracted by the back and forth traversing movement of the longwall shearers, the shield supports 50 are progressively forwardly advanced. The area of the mine roof immediately behind the shield supports is permitted to collapse as illustrated in FIG. 1; however, the tailgate and headgate entries 18 and 20 remain in place.

FIG. 1 illustrates the prior art roof support system for the recovery room 32 which is developed before the longwall panel 12 is extracted. The longwall mining machine progressively advances the face of the panel 12 from the set-up room to the recovery room 32. The panel 12 is extracted completely through a termination line 52, shown in FIG. 1, where the panel breaks open into the recovery room 32. When the longwall mining machine reaches the recovery room 32, it is disassembled. The disassembled mining machine and the shield supports 50 are moved from the recovery room 32 through the chutes 34–38 and the cross entries 40 and 42 to the next location for setup.

As the longwall shearers approach the recovery room 32 substantial abutment pressures build up in the solid pillar positioned immediately in front of the shield supports 50 up to the termination line 52. In order to resist the abutment pressures and prevent failure of the panel and the roof immediately in front of the shield supports, particularly for a friable rock strata, the strata above the roof of the recovery room 32 must be adequately reinforced so that the intense abutment pressures can be dissipated through the reinforced strata above the recovery room 32 to the adjacent solid pillars. If the roof support for the recovery room 32 is inadequate to withstand and dissipate the abutment pressures to surrounding stable rock strata, the roof between the shield supports and the recovery room will fail as illustrated in FIG. 1.

In the past it has been the practice to reinforce the area immediately in front of the shield supports 50 with the wire meshing and wire rope trusses. This requires a slow down in the material extraction process and also subjects the personnel installing the additional roof support to hazardous conditions when they must work ahead of the shield supports. As illustrated in FIG. 1, the conventional method of roof support for the recovery room 32 includes cribs 54 and 56 positioned at the termination line 52 of the longwall panel 12 and at the opposite outby wall 57. Conventional roof bolts 58 are anchored in the mine roof in a selected bolt pattern. In those instances where the roof in front of the advancing shield supports 50 does not collapse the shearers advanced through the termination line 52 into the recovery room 32.

The shearers' advance into the recovery room 32 is intended to cut out the row of cribs 54 without incident. However, in those instances where the abutment pressures override into the roof in advance of the shield supports 50 and the roof fails, the longwall mining operation must be stopped to clear the roof fall and install wire meshing and roof bolts where the roof has collapsed in advance of the shield supports. Therefore, in accordance with the present invention a roof control system is provided for the recovery room 32 and the other adjacent entries and passageways formed in the longwall mining operation that prevents roof falls in the area approaching the recovery room and in adjacent entries. The roof control system of the present invention also serves to eliminate the use of cribbing in the recovery room and in other areas, such as the headgate and tailgate entries, chutes, and at the intersection of entries.

In order to eliminate the risks of exposing personnel to hazardous conditions ahead of the shield supports as the panel face approaches the recovery room 32, it was determined that the roof of the recovery room must be reinforced to withstand the abutment pressures. As illustrated in FIGS. 3, 4, 7 and 8 the recovery room is expanded in width in two stages from a conventional width of about sixteen feet utilized with the prior art system to about thirty-six feet with the present invention. By expanding the width of the recovery room to approximately twice the width utilized in the prior art system, a roof support system is installed that reinforces the unstable rock strata over the recovery room to withstand the abutment pressures. With the present invention, the strata above the recovery room takes up or absorbs the abutment pressures and transmits them to surrounding, more stable strata.

Figure 7:
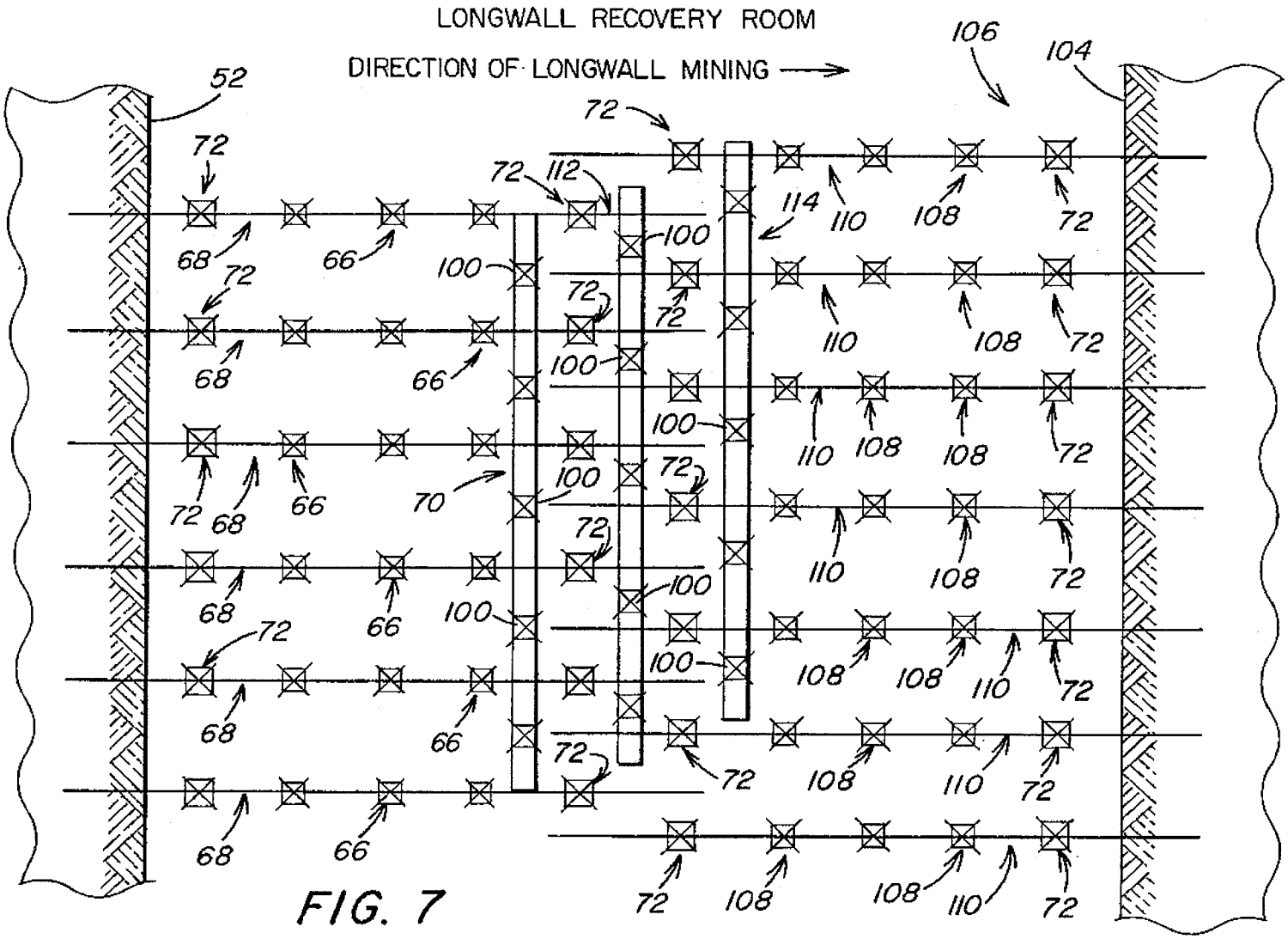
FIG. 7 is a schematic plan view of the recovery room after the second stage of development with a completed roof control system.
Figure 8:
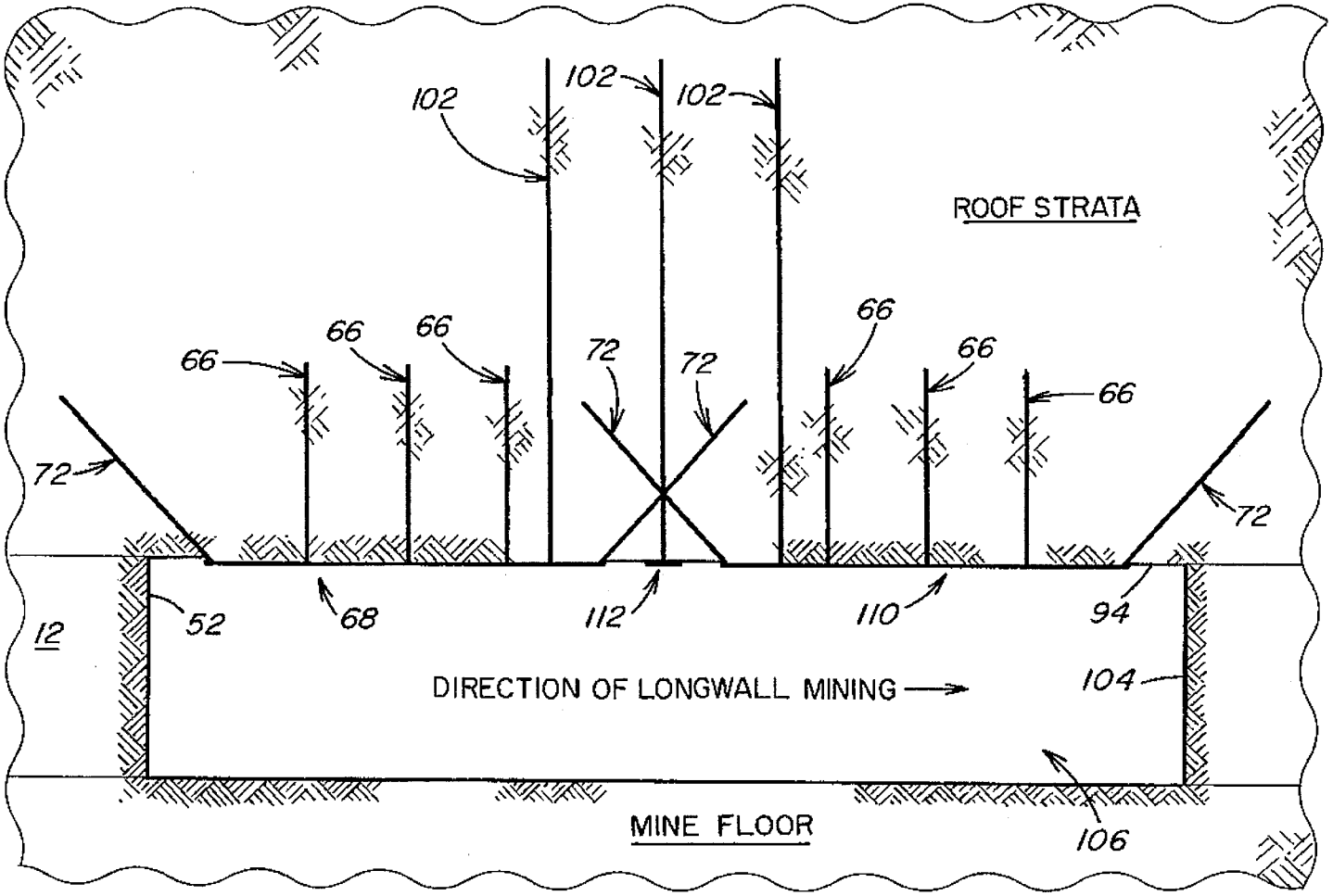
FIG. 8 is a schematic view in side elevation of the expanded recovery room and roof support system therefor as shown in FIG. 7.

The expanded roof support system installed above the recovery room, as illustrated in FIGS. 7 and 8, reinforces the rock strata so that the intense abutment pressures that are encountered when the advancing face of the panel 12 approaches the recovery room are transmitted through the panel between the panel face and the recovery room 32 to the reinforced strata above the recovery room and therefrom to the solid pillars 44 remaining in place behind the recovery room 32 as illustrated in FIG. 2. With this system, the longwall mining operation is not slowed down or interrupted as it approaches the panel termination line 52 for the installation of support immediately in front of the shields to prevent failure of the pillar between the shield supports 50 and the panel termination line 52.

Prior to the extraction of the panel 12, the recovery room is constructed in accordance with one method in two stages. However, it should be understood that the recovery room may also be constructed by another method in one stage where a narrower recovery room is feasible in view of more stable rock strata above the recovery room roof to resist the abutment pressures of an advancing panel face. In both methods, the resultant roof support system shown in FIG. 7 is utilized.

Figure 3:
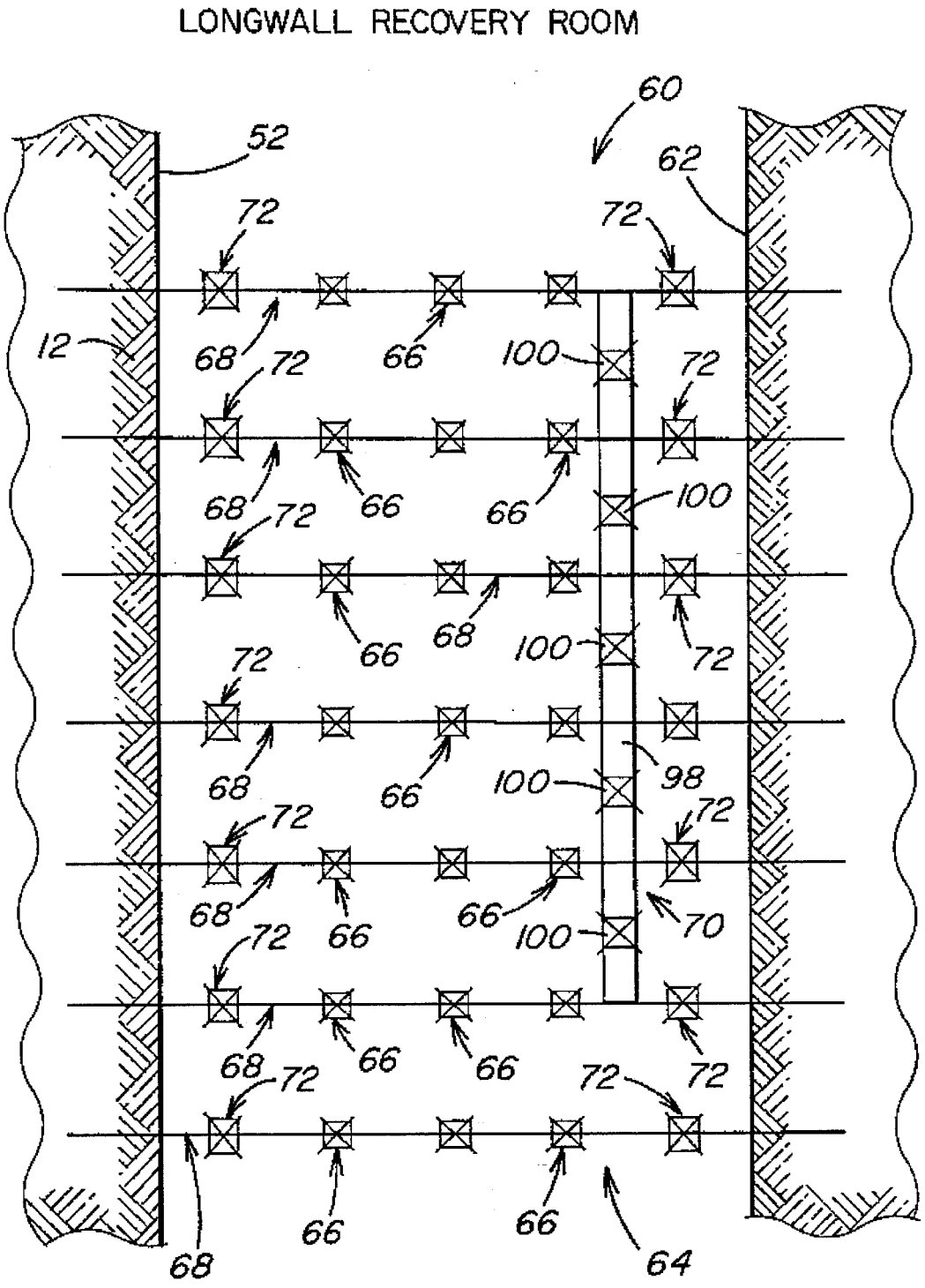
FIG. 3 is a schematic plan view of the first stage of the roof support system for the recovery room behind the longwall panel shown in FIG. 2.
Figure 4:
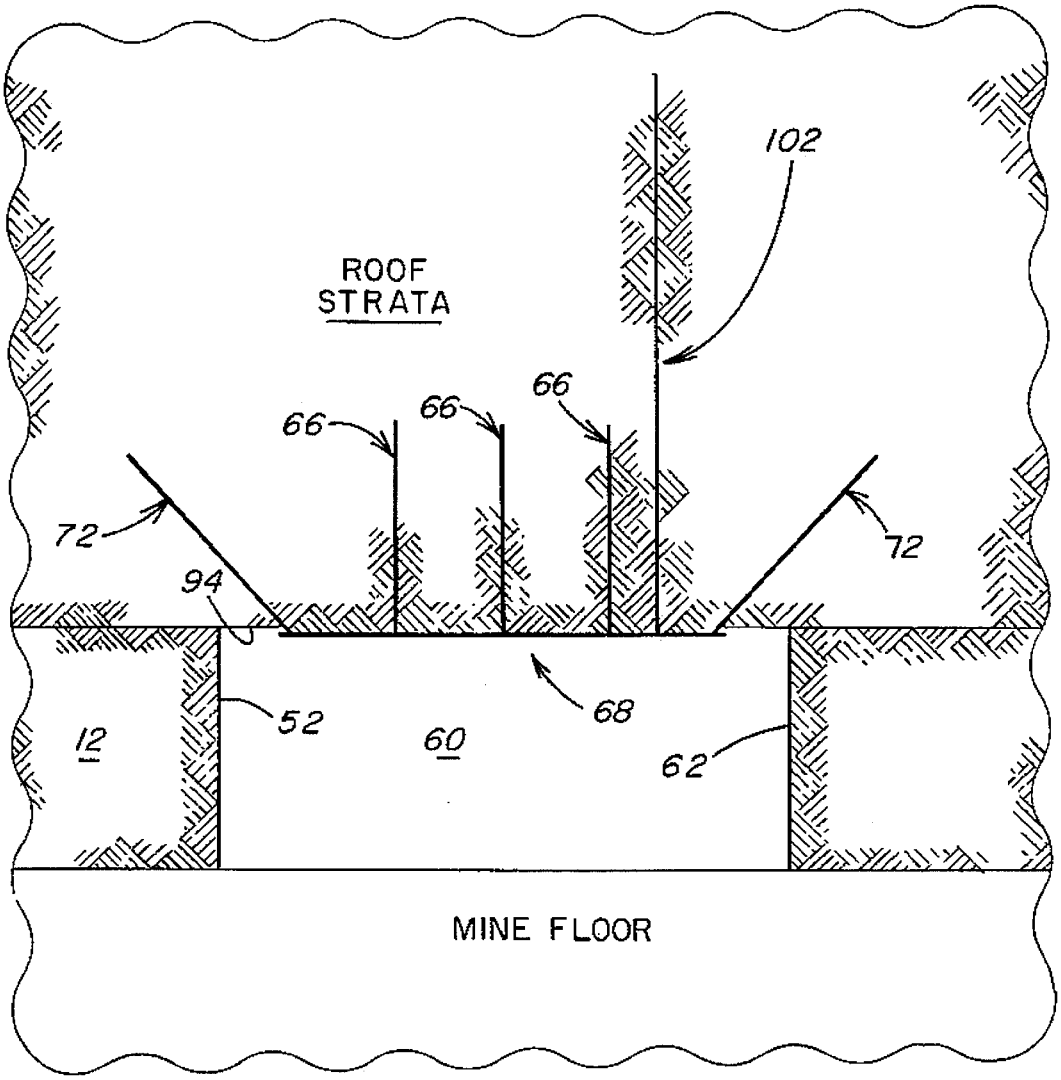
FIG. 4 is a schematic view in side elevation of the first stage development of the recovery room shown in FIG. 2, illustrating the roof support system.

In the first stage of construction, as illustrated in FIGS. 3 and 4, a recovery room 60 is cut a preselected width the full transverse length of the longwall panel 12, for example about 750 feet. The roof control plan constructed during the first stage is shown in FIGS. 3 and 4. In the second stage, as illustrated in FIGS. 7 and 8, the recovery room 60 is doubled in width from the initial stage and additional roof support is installed in a preselected pattern in accordance with the present invention. In this manner, the rock strata over the recovery room is reinforced to resist abutment pressures as the advancing panel face proceeds through the termination line 52 into the recovery room without failure of the overhead strata. Expanding the recovery room width permits reinforcement of friable overhead strata so that the strata is more stable. If the expanse of the friable strata over the recovery room is limited, the strata is adequately reinforced in one stage.

Referring to FIGS. 3 and 4, there is illustrated a recovery room generally designated by the numeral 60 constructed of an initial width and extending the entire transverse length of the panel 12 between the tailgate entry 18 and the headgate entry 20 as shown in FIG. 2. In the first stage of construction the width of the recovery room 60, as shown in FIG. 3, extends between the termination line 52 at the inby side to an opposite wall 62 at the outby side. In one example, this width is approximately eighteen feet.

Across the width of the recovery room is initially installed a roof support system generally designated by the numeral 64. The roof support system 64 includes primary support provided by a plurality of mechanically anchored roof bolt assemblies generally designated by the numeral 66. The roof bolt assemblies 66 are commercially available and sold under the trademark "INSTáL®" by Jennmar Corporation. A roof bolt assembly suitable for use in the present invention is illustrated and described in detail in U.S. Pat. No. 5,244,314 which is incorporated herein by reference. Each of the roof bolt assemblies 66 includes a grade 75, ⅞ inch diameter roof bolt in a length of six feet. Secured to the end of the bolt is a ⅞ inch diameter expansion shell assembly and a resin compression ring. An anti-friction washer is positioned on the outer end of the bolt emerging from the bore hole between a roof plate and a forged head on the roof bolt. The end of the bolt in the bore hole is anchored by both the mechanical expansion shell and a resin bonding system that provides at least two feet of mixed and cured resin along the upper end of the roof bolt. With this arrangement each roof bolt assembly 66 is both mechanically and chemically anchored within the bore hole to maintain the bolt in tension and thereby compress the overlying layers of rock strata above the recovery room 60.

In order to supplement the primary roof control system provided by the roof bolt assemblies 66 to withstand the frontal abutment pressures exerted at the advancing panel face, supplemental support is provided by a combination of roof truss assemblies generally designated by the numeral 68 and an initial roof channel generally designated by the numeral 70 in FIG. 3. With this arrangement, the roof of the recovery room is stiffened or reinforced to a degree that the abutment pressures exerted by the advancing panel upon the pillar adjacent the recovery room in advance of the shield supports 50 are transmitted from the reinforced strata above the recovery room to the solid rock strata over the pillars surrounding the recovery room.

Figure 5:
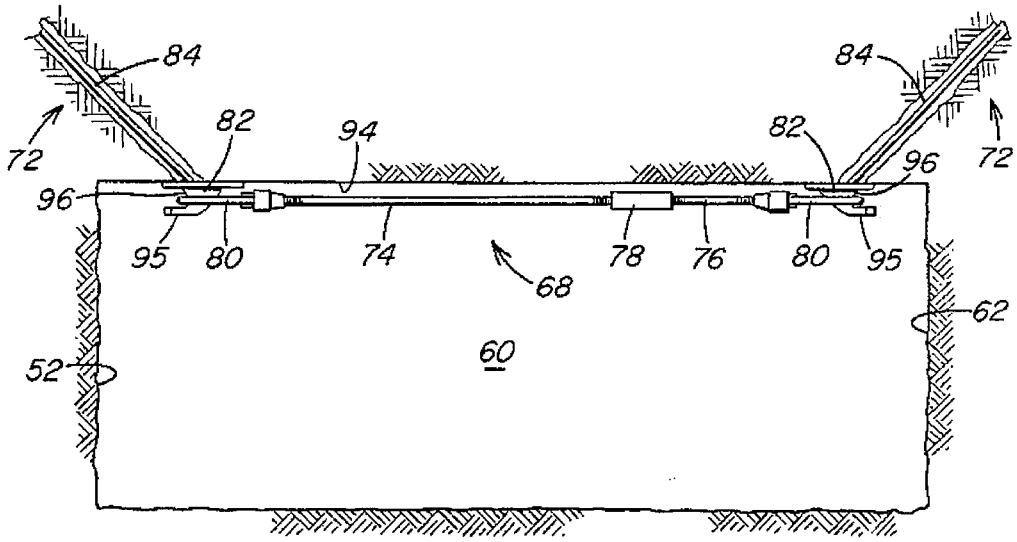
FIG. 5 is a view similar to FIG. 4 of the first stage development of the recovery room, illustrating a roof truss system used in the recovery room.
Figure 6:
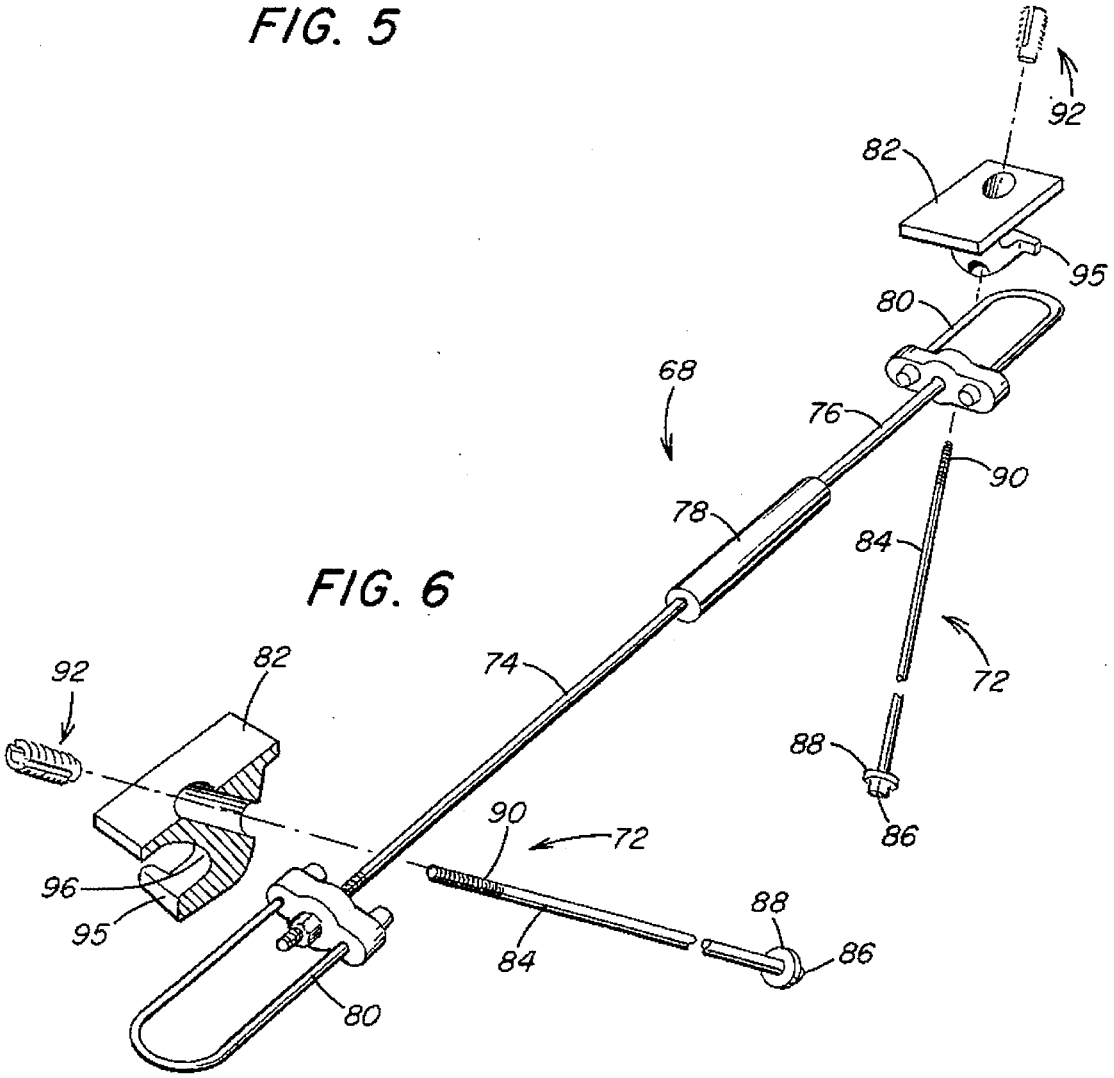
FIG. 6 is an exploded isometric view, partially in section, illustrating the components of the roof truss system shown in FIG. 5.

As seen in FIG. 3, a plurality of roof truss assemblies 68 spans the width of the initial recovery room 60. The assemblies 68 are spaced a preselected distance apart, for example, four feet apart. The detailed structure of each roof truss assembly 68 is shown in FIGS. 5 and 6 and is described and illustrated in greater detail in U.S. Pat. No. 5,302,056 which is incorporated herein by reference.

Each roof truss assembly 68 uses a connected arrangement of grade 75 one inch diameter rods 74 and 76. The rods 74 and 76 are connected by a coupler 78. The end portions of the coupled rods are secured as close as possible to the rib forming the panel termination line 52 at the inby side of the recovery room 60 and at the opposite rib or wall 62 at the outby side of the recovery room by U-bolts 80 and brackets 82 to roof bolt assemblies generally designated by the numeral 72. Each roof bolt assembly 72 corresponds in construction to the roof bolt assemblies 66 described above and disclosed in U.S. Pat. No. 5,244,314 for the primary support system of the recovery room roof.

The roof bolt assemblies 72 each include an elongated roof bolt 84 having an enlarged head 86 with a washer 88 at one end and an opposite threaded end portion 90. A mechanical expansion shell assembly generally designated by the numeral 92 is threadedly engaged to the bolt end portion 90. As well known, upon rotation of the roof bolt assembly 72, the shell assembly 92 expands into gripping engagement with the wall of the bore hole to exert tension on the bolt 84 with the head 86 of the bolt bearing against the bracket 82 compressed against the mine roof 94. To increase the anchorage of the roof bolt assembly 72 within the mine roof bore hole, resin is used in combination with the roof bolt assembly 72 when it is installed. The use of resin adds strength to the anchorage of the bolt 84 in the bore hole when torque is applied to the bolt end portion 86.

The roof bolt assemblies 72 are inserted into bore holes drilled into the mine roof at approximately a 45° angle so that the holes extend into the rock strata supported by pillars. Once the roof bolt assemblies 72 are anchored in the solid rock strata, the U-bolts 80, connected to separate rods 74 and 76, are positioned on an arm member 95 of the truss bracket 82 with the arcuate, closed end of the U-bolt 80 positioned oppositely of an abutment wall 96 of the bracket 82. The adjacent ends of the rods 74 and 76 are connected to the coupler 78. The coupled rods 74 and 76 are then placed in tension by rotation of the coupler 78 whereby the U-bolts 80 are maintained compressed against the bracket abutment wall 96, as shown in FIG. 5. Tensioning the anchored truss assemblies 68 shifts the weight of the rock strata over the mined out area of the initially formed portion of the recovery room 60 upwardly into the solid rock strata over the solid pillar remaining forward of the advancing longwall shearers at the inby side of the recovery room 60 and the solid material at the outby side of the recovery room 60.

As the longwall dislodging operation progresses toward the termination line 52 for the panel 12, the shield supports 50 also advance toward the termination line 52. As the shield supports get closer and closer to the termination line, the roof bolt assemblies 66 anchored in the strata above the termination line combine with the shield supports 50 to maintain the pillar between the shield supports and recovery room in place. By installing the angled roof bolts 72 close to the rib at the termination line 52, the roof truss assemblies 68 in the recovery room 60 interact with the shield supports 50 opposite the panel face to reinforce the roof between the shield supports and the termination line 52 to withstand the abutment pressure and prevent failure of the roof.

In addition to the combination of the roof bolt assemblies 66 and the roof truss assemblies 68, the roof control system of the present invention also includes in the initially formed portion of the recovery room 60 a roof channel generally designated by the numeral 70 in FIG. 3. The roof channel 70 extends parallel to and is relatively closely spaced from the outby wall 62. The channel 70, in one example, is positioned approximately four feet from the outby wall 62 and has a preselected length of about twenty feet which is less than the longitudinal length of the recovery room 60 between the tailgate entry 18 and the headgate entry 20. Therefore, a number of roof channels 70 are positioned in end to end relation the length of the outby wall 62.

A commercially available roof channel for use with the present invention is made and sold by Jennmar Corporation and is described and illustrated in detail in U.S. Pat. No. 5,292,209 which is incorporated herein by reference. The roof channel 70, as shown in FIG. 3, includes a high strength reinforced steel channel 98 having a plurality of openings spaced a preselected distance apart along the center line of the channel. A bearing plate 100 is positioned in overlying abutting relation with each opening. A roof bolt assembly generally designated by the numeral 102 in FIG. 4 extends through each of the aligned openings of the bearing plate 100 and channel 98 into a bore hole drilled vertically into the rock strata above the roof of the initial recovery room 60.

Preferably, the roof bolt assemblies 102 include a grade 75 one inch diameter roof bolt in a length of sixteen feet. Upon completion of the installation of the roof bolt assemblies 66, the roof truss assemblies 68 and the roof channel 70, the rock strata above the initial recovery room 60 is substantially reinforced to resist the abutment pressures exerted by the advancing panel face. After the first stage construction of the recovery room 60 is completed, the width of the recovery room is expanded in a second stage as illustrated in FIGS. 7 and 8.

Referring to FIGS. 7 and 8, there is illustrated the second stage in the development of the longwall recovery room 60 which is widened to substantially twice the width of the initially formed recovery room 60 shown in FIGS. 3 and 4. In the example of the present invention shown in FIG. 3, the recovery room 60 is initially constructed to a width of approximately eighteen feet between the termination line 52 and the opposite outby wall 62. Then in the second stage of development shown in FIG. 7, the width of the recovery room is expanded an additional eighteen feet for a total width of approximately thirty-six feet extending from the termination line 52 to the final position of an outby wall 104.

With this method, a recovery room generally designated by the numeral 106 in FIGS. 7 and 8 is formed having a total width of approximately thirty-six feet and a length corresponding to the transverse length of the mine panel 12 between the tailgate entry 18 and the headgate entry 20 as shown in FIG. 2. However, the recovery room 106 can be narrower than thirty-six feet in width and constructed in one stage rather than two stages if the condition of the overhead rock strata is more stable and capable of withstanding the abutment pressures without requiring the degree of roof support provided by expanding the width of the recovery room in a two-stage development.

As seen in FIGS. 7 and 8, the roof control system for the completed recovery room 106 includes a plan having primary and supplemental roof support systems corresponding to those used for the roof control system in the initial recovery room 60 shown in FIG. 3. The roof support system in the expanded section of the recovery room 106 includes roof bolt assemblies 108 corresponding to the roof bolt assemblies 66, roof truss assemblies 110 corresponding to the roof truss assemblies 68 and roof channels 112 and 114 each corresponding to the roof channel 70 described above.

As seen in FIG. 7, the support plan for the roof bolt assemblies 108, roof truss assemblies 110, and the roof channels 112 and 114 are positioned in an offset relationship with respect to the corresponding support devices installed during the initial stage of development of the recovery room 60 shown in FIG. 3. The roof bolt assemblies 108 installed in the expanded section of the recovery room 106 are positioned in rows which are laterally offset a preselected distance from the rows of roof bolt assemblies 66 installed in the first stage of the development of the recovery room. In one example, the rows of roof bolt assemblies 108 are offset a distance of about two feet from the rows of roof bolt assemblies 66. Similarly, the roof truss assemblies 110 in the expanded section of the recovery room 106 are offset a selected distance, for example two feet, from the roof truss assemblies 68 installed in the initial recovery room 60.

The offset spacing of the truss assemblies 68 and 110 serves to prevent interference in the installation and anchorage of the angled roof bolts for the truss assemblies at the adjacent end portions at the center of the recovery room 106. The offset relationship of the angled roof bolt assemblies for the trusses also provides uniform distribution of the reinforcement of the strata above the recovery room roof. This arrangement avoids excessive stress concentrations at the points where the angled roof bolts are installed in the mine roof. Also, by spacing the various support systems in a preselected pattern across the expanse of the roof of the recovery room 106, the systems interact to provide complete support of an expansive area not otherwise adequately supported by conventional roof support methods.

At the center of the expanded recovery room 106, the additional roof channels 112 and 114 are installed in spaced parallel relation with the initial roof channels 70. Preferably, the roof channels 70 and 112 are spaced about four feet apart on center as are roof channels 114 and 112. The roof channels 112 and 114 correspond in structure to the roof channel 70. The steel channel members 70, 112 and 114 each include a plurality of openings spaced a distance apart along the length of the channel member to receive the roof bolt assemblies 102. This arrangement provides uniform distribution of the reinforcement by the roof bolt assemblies 102 located at the center span of the recovery room 106.

The respective channel members 70, 112, and 114 are positioned so that the holes through the channel members for receiving the roof bolt assemblies 102 are not aligned oppositely of one another. The channel members are positioned so that the holes are offset or staggered as shown in FIG. 7. In FIG. 7, the positions of the bearing plates 100 indicate the location of the holes in the channel members where the roof bolt assemblies 102 are installed.

The offset spacing of the channel member holes is coordinated with the offset spacing of the roof truss assemblies 68 and 110 at the mid span area of the recovery room roof. At the mid span area, the roof truss assemblies 68 and 110 and roof channels 70, 112, and 114 are positioned in overlying relationship. The staggering of the roof channels permits the angled roof bolts 72 for the trusses 68 to be installed without interference by the roof channels. For the center roof channel 112, the holes for the sixteen foot bolts are positioned between adjacent truss members 68 and 110, thereby distributing the forces applied by these roof support systems to the overhead rock strata.

As seen in FIG. 7, the full width of the recovery room 106 between the termination line 52 and the outby wall 104 is not traversed by a single roof truss. A single roof truss is not feasible for a recovery room having the expanded width of recovery room 106 of the present invention. However, the effect of a single roof truss spanning the full width of the recovery room is accomplished by the offset arrangement of the roof truss assemblies 68 and 110 between the inby wall or termination line 52 and the outby wall 104.

As shown in FIG. 7, the trusses 68, 110 meet in offset relation at the mid span area in overlying relation with the roof channels 70, 112 and 114. The staggered arrangement of roof truss assemblies 68, 110 and roof channels 70, 112, 114 interact with the primary roof support achieved by the offset rows of roof bolt assemblies 66, 108 to provide a concentrated support system. This support system uniformly distributes compressive forces throughout the rock strata above the roof of the recovery room 106 and into the adjacent areas of the rock strata supported by the solid pillars.

As described above, the recovery room 106 is constructed in two stages to form a recovery room approximately twice the width of conventionally known recovery rooms in a longwall mining operation. Expanding the recovery room width permits installation of a roof support system that replaces friable rock strata that otherwise presents hazardous conditions to operating personnel and equipment. The roof control system of the present invention includes a variety of roof support devices designed to interact with one another to enhance the roof support and eliminate the risks associated with friable rock strata.

The overhead support achieved in a thirty-six foot wide recovery room by the roof control system of the present invention provides greater support to resist the abutment pressures generated by the advancing mine face than for an eighteen foot recovery room surrounded by friable rock strata. Removing the friable rock strata by expanding the width of the recovery room and reinforcing the roof of the recovery room by the control system of the present invention solves the problem of failure of the roof immediately forward of the shield supports 50 near the panel termination line 52.

With an expanded and reinforced recovery room 106, the longwall shearers maintain a normal rate of advancement because the roof and mine face remain intact throughout the recovery operations. The longwall shearers break through the termination line 52 and advance into the recovery room 106 without failure of the rock strata above the roof of the recovery room. Furthermore, the recovery room remains intact to permit disassembly of the face equipment and its movement through the recovery chutes 34, 36 and 38 extending off the recovery room as shown in FIG. 2.

Figure 10:
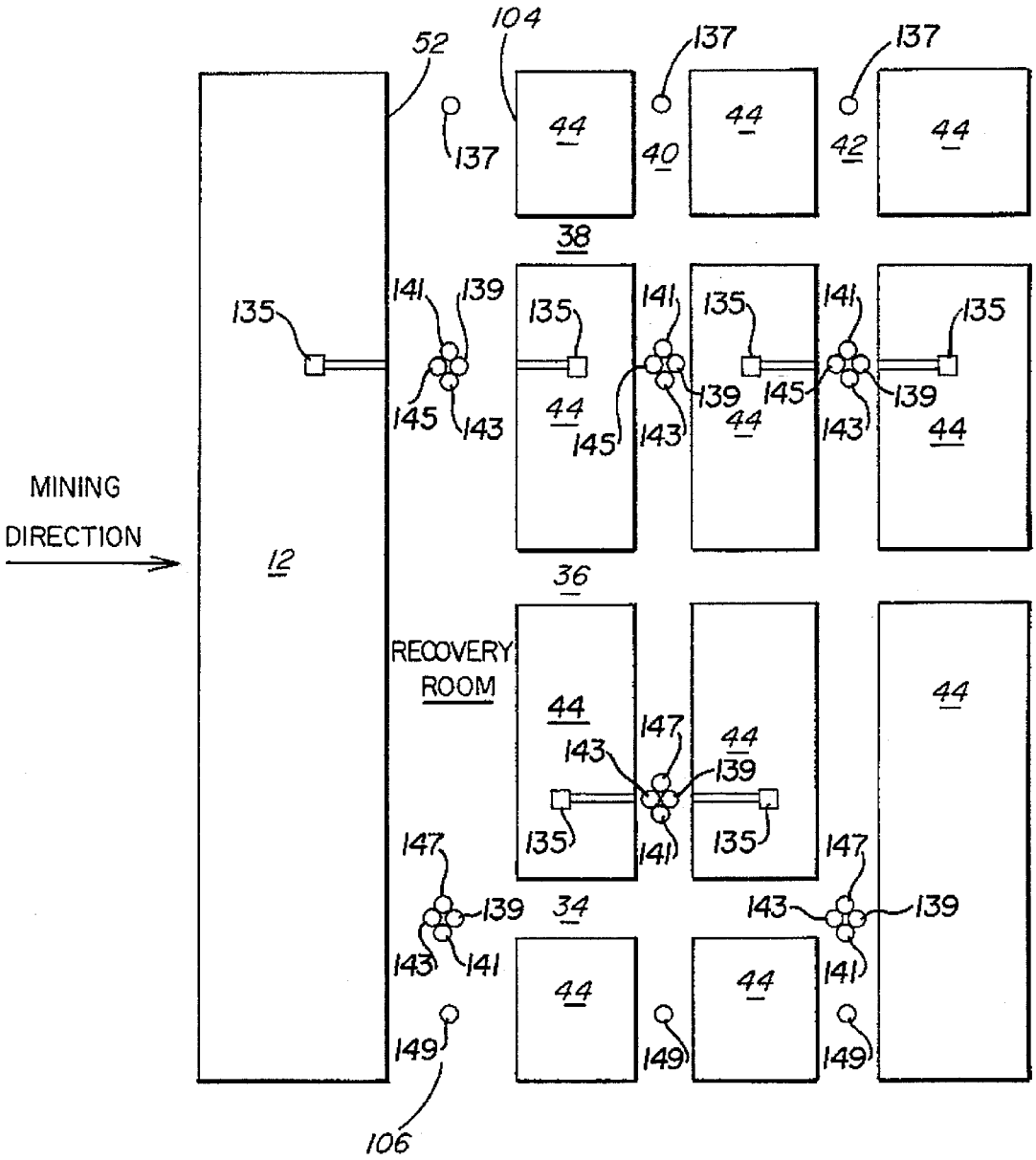
FIG. 10 is an enlarged schematic plan view of the longwall mine layout behind the panel to be extracted, illustrating an instrumentation plan for monitoring the operability of the roof support system installed in the recovery room, entries and chutes extending from the recovery room.

Referring to FIG. 10, there is illustrated in detail the layout of the longwall mine behind the recovery room 106 expanded and supported in accordance with the present invention. Extending through the outby wall 104 of the recovery room 106 are cut recovery chutes 34, 36 and 38. The chutes 34–38 intersect transversely with cross entries 40 and 42 which extend parallel to the recovery room 106. The formation of the intersecting chutes 34–38 and cross entries 40 and 42 leaves a number of pillars of rock material in place to support the overhead strata. The passageways provided by the chutes and cross entries are used to transport the disassembled longwall mining machinery to the next set-up room for dislodging another panel. The intersections of the chutes and cross entries are supported by a system that includes the roof support devices used in the recovery room as discussed above.

Figure 9:
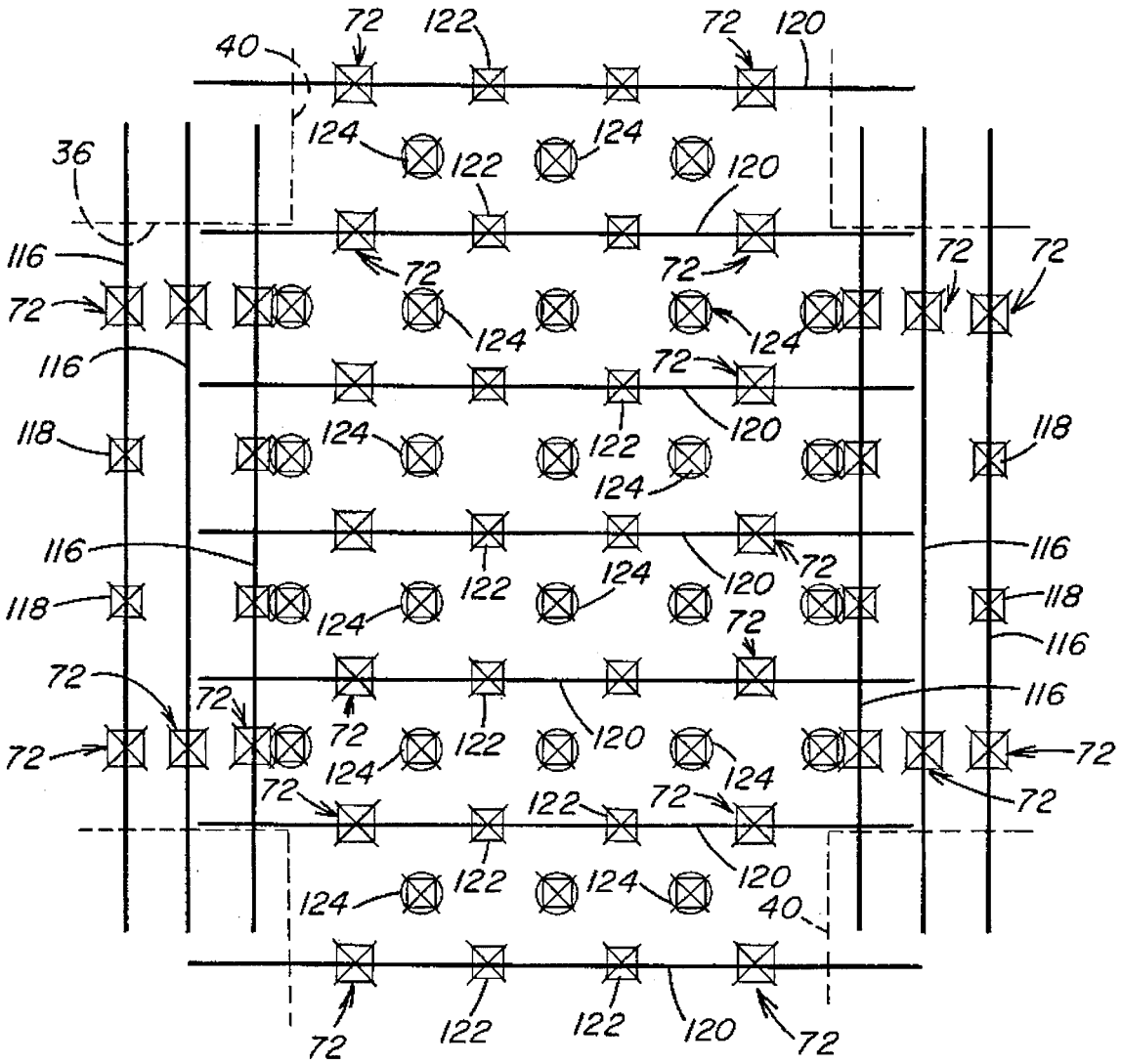
FIG. 9 is a schematic plan view of one of the intersections formed by a recovery chute and an entryway at the rear of the recovery room, illustrating the roof support system for the intersection.

FIG. 9 illustrates a roof support system used at the intersection of recovery chute 36 and cross entry 40. This system is used at the intersection of each recovery chute and cross entry. Each of the recovery chutes 34–38 includes a roof support plan formed by truss assemblies 116 that extend the full width of each chute and are installed four feet apart. The truss assemblies 116 are also supplemented by roof bolt assemblies 118. The truss assemblies 116 correspond to the truss assemblies illustrated in FIGS. 5 and 6 and described above in which coupled rods 74 and 76 are connected at their end portions to roof bolt assemblies 72 that are angled to extend into the solid material of the pillars forming the passageways. The cross entries are also provided with overhead roof support the full length of the entries.

Truss assemblies 120 are installed the length of the cross entry 40 and extend through the intersection with the recovery chute 36 as well as the recovery chutes 34 and 38 shown in FIG. 10. Roof bolt assemblies 122 are also positioned in underlying relationship with the truss assemblies 120. Supplementing the truss assemblies 120 in the cross entry 40 are rows of roof bolt assemblies 124. The roof bolt assemblies 124 also correspond to the roof bolt assemblies used in the recovery room and the other passageways of the mine. The rows of the roof bolt assemblies 124 are positioned between adjacent roof truss assemblies 120 in the cross entry 40. This pattern of roof support is repeated the entire length of the cross entry 40.

At the intersection of chute 36 and cross entry 40 illustrated in FIG. 9, the roof bolt assemblies 124 preferably include sixteen foot length bolts as above described for the longwall recovery room. Accordingly, with the roof control pattern shown in FIG. 9, each four way intersection includes twenty-six roof bolts each having a sixteen foot length extending vertically into the overhead rock strata. With this arrangement of truss assemblies and roof bolt assemblies at each intersection, the risks of a roof fall occurring due to a pressure shift induced by the trusses installed in the cross entryways is substantially reduced.

Figure 11:
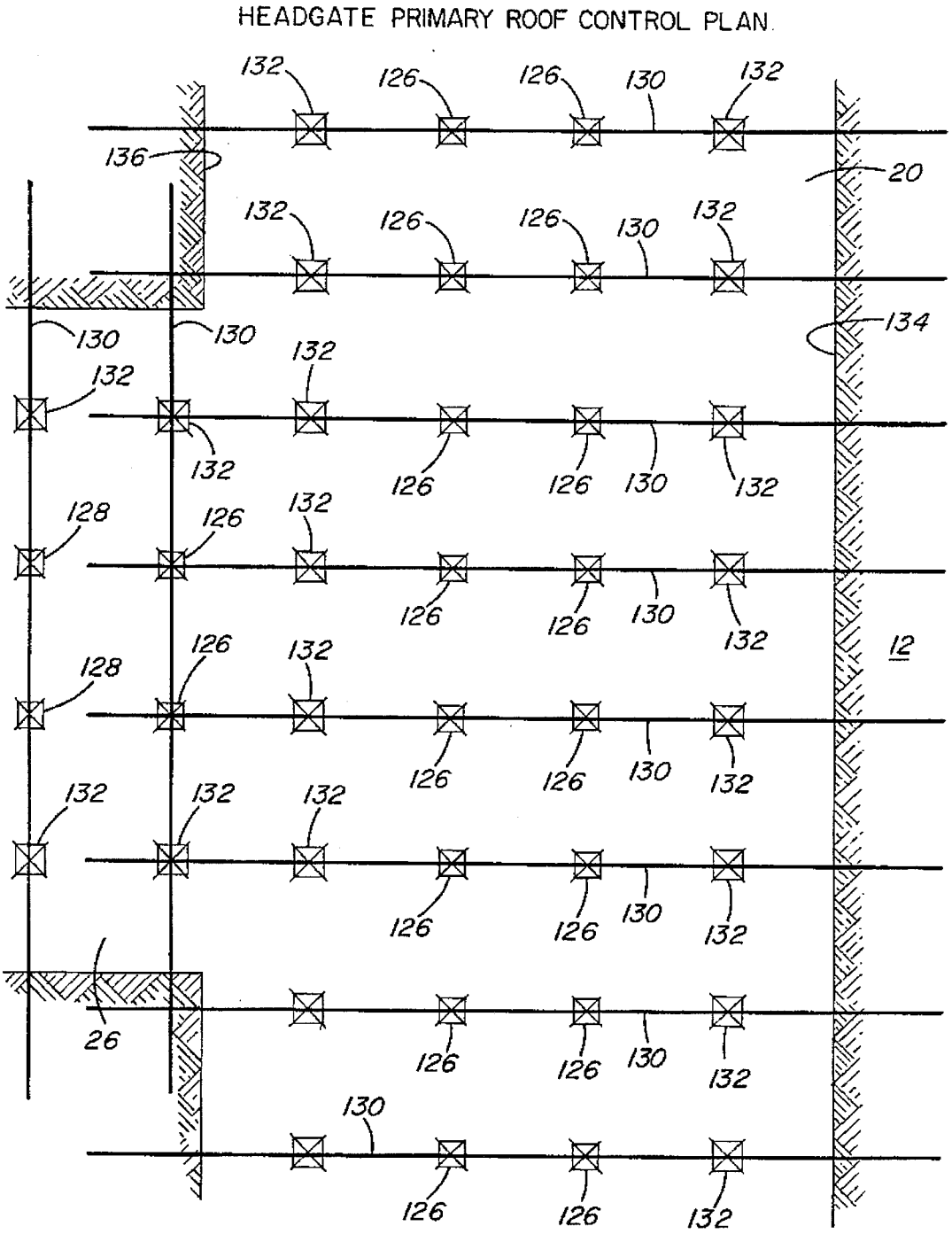
FIG. 11 is a schematic plan view of the roof support system for a headgate entry.
Figure 12:
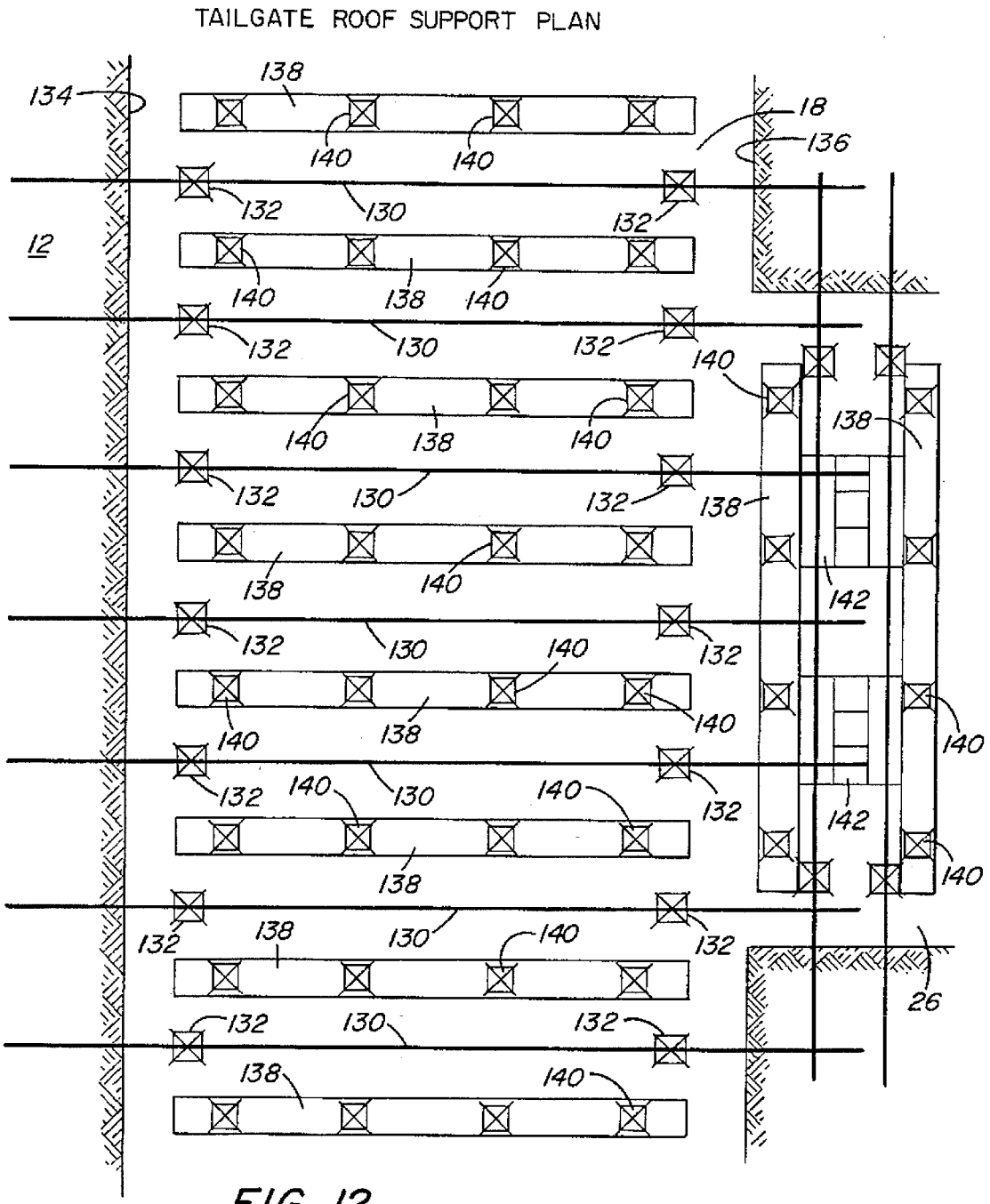
FIG. 12 is a schematic plan view of the roof support system for a tailgate entry.

As illustrated in FIG. 2, the tailgate entry 18 and the headgate entry 20 extend the length of the longwall panel 12 to be dislodged from the set-up room (not shown) to the recovery room 32. As the tailgate and headgate entries are developed, the exposed overhead roof of the respective entries is supported with a roof control system in accordance with the present invention. The strata above the tailgate and headgate entries is supported to resist the lateral pressures exerted on the strata as the panel 12 is advanced and the overhead strata behind the shield supports 50 is allowed to cave in. FIGS. 11 and 12 illustrate the roof control systems installed in the headgate and tailgate entries respectively.

Figure 13:
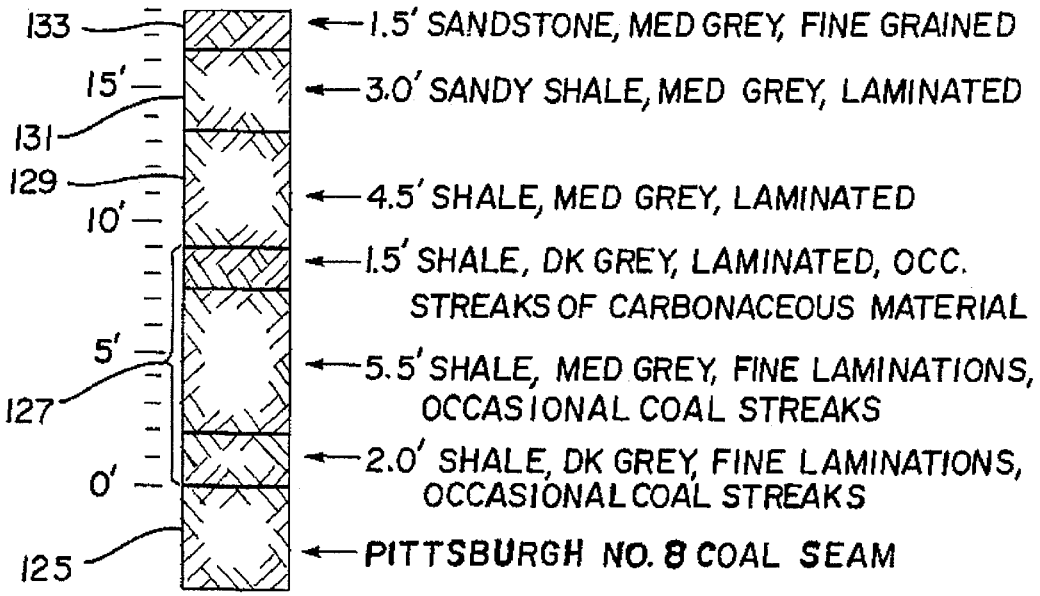
FIG. 13 is a representative diagrammatic illustration of the composition of the rock strata above an excavated area in the longwall mine.

Before the roof control systems are installed in the passageways formed during the longwall mining operation, including the recovery room, headgate and tailgate entries, and the chutes associated therewith, a stratascope analysis of the overhead strata is conducted. This is accomplished by drilling bore holes of approximately twenty feet into the mine roof and advancing a camera or a video Stratacam VCR in the bore holes to obtain a visual record of the composition of the rock strata and to identify any fracture or bed separation patterns. The recorded information is then used to prepare a graphic representation, known as a Stratigraph, illustrating the composition of the layers that make up the rock strata. A sample Stratigraph is shown in FIG. 13 for a bore hole approximately twenty feet in length. The first layer above the coal seam 125 is a series of laminations or layers 127 formed of shale. The shale laminations extend to a depth of approximately nine feet in the bore hole 123 and contain streaks of coal and carbonaceous material. Above the shale layer 127 extends another shale laminated layer 129 which is substantially free of carbonaceous material. Above the shale layer 129 extends another layer 131 of a sandy laminated shale. A layer 133 of sandstone is positioned above the sandy shale layer 131.

The stratascope analysis also provides an indication of any significant fractures or bed separations in the immediate mine roof strata. Having identified the composition of the mine roof strata and the presence of any fractures or bed separations, the roof support system that would be required to support the strata having the identified composition is designed and installed. The roof support system for a longwall recovery room includes primary and secondary roof support devices as shown in FIGS. 7 and 8 and based on the Stratigraph analysis.

To monitor the effectiveness of the primary and secondary roof support systems as well as the individual systems, such as the roof bolt assemblies, roof truss assemblies, and roof channels as above described and illustrated, an instrumentation plan is implemented at desired locations throughout the mine. FIG. 10 illustrates an example instrumentation plan installed in the recovery room and the chutes and entries extending off the recovery room. The instrumentation plan includes a selected combination of stress meters 135, convergence stations 137, load cells 139, and strain gages 141 on the trusses. Stratascope bore holes 143 are drilled at selected locations to obtain information on the composition of the overlying rock strata. Convergence stations 145, 147, 149 and 151 are also included.

Figure 18:
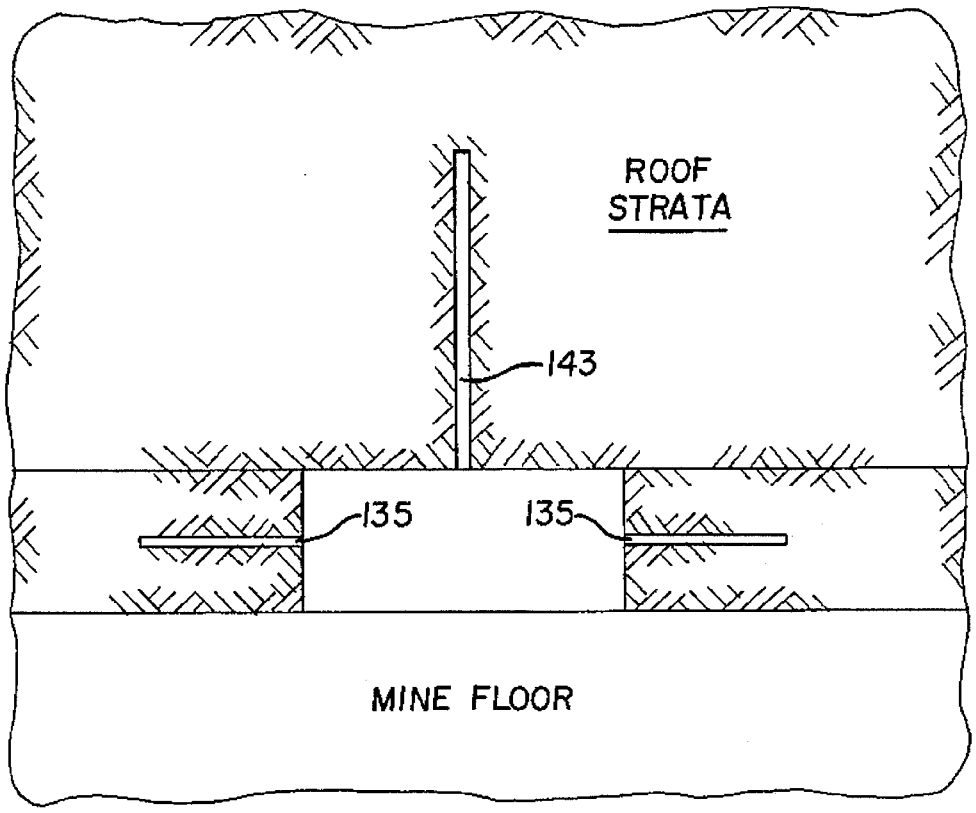
FIG. 18 is a schematic illustration of bores drilled in the rock strata surrounding an excavated area in a longwall mine for receiving instruments for measuring the pressure loads applied by the surrounding strata.

A suitable stress meter for use with the present invention is a vibrating wire stress meter, Model No. 4300EX manufactured by Geokon Inc. of Lebanon, N.H. The stress meters 135 of this type measure the abutment pressure and are installed in horizontal holes drilled approximately twenty-five feet into the panel and fifteen feet into a yield panel. See FIG. 18.

The convergence stations 137 are constructed using a pair of convergence meters positioned oppositely of one another in the mine roof and floor. A suitable convergence meter for use with the present invention is Model No. EXT-9301 manufactured by RocTest Inc. The oppositely positioned convergence meters measure floor to roof convergence.

The load cells 139 are installed in the roof using non-tensioned rebar bolts. A suitable load cell for use with the present invention is a Model No. D-3054 roof bolt compression pad and Model No. 61967 gage manufactured by Goodyear Tire and Rubber Co.

Figure 14:
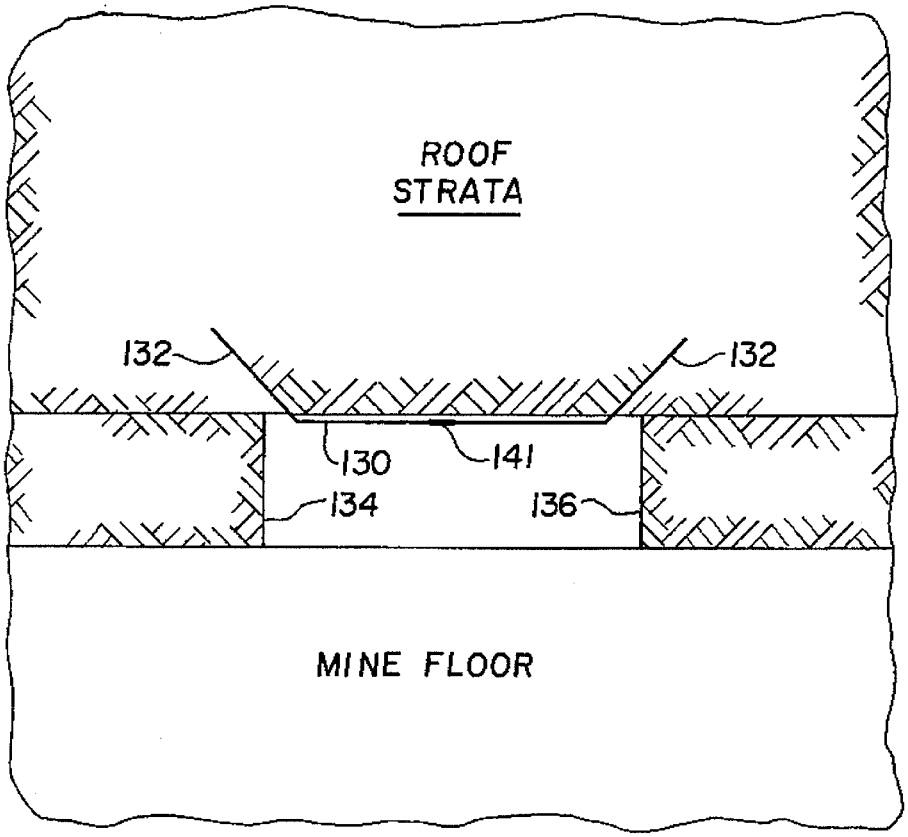
FIG. 14 is a schematic view in side elevation of the instrumentation for measuring the load applied to a roof truss of the present invention.

The strain gages 141 measure the load exerted on the tie rod of the truss systems. See FIG. 14. A suitable strain gage for mounting on the truss tie rods is Model No. EA-06-250BG-120 LE manufactured by Measurement Group, Inc.

As indicated in FIG. 10, the convergence stations 137, load cells 139, and strain gages 141 are installed at the mine roof and floor with the stress meters 135 installed in horizontal holes drilled into the surrounding panels. Preferably, the instruments are installed at the time the roof supports are installed and the readings are taken as the longwall mining operation progresses toward the recovery room and as the panel is advanced through the termination line into the recovery room. The stratascope bore holes 143 are preferably drilled prior to the installation of the roof support systems in order to initially determine the strata composition and then design the roof support system required for the particular strata encountered. In addition, bore holes are drilled throughout the mine and particularly in the recovery room and in adjacent chutes and entries to determine any changes that occur in bed separation or fracturing as the longwall panel is advanced toward the recovery room.

Figure 15:
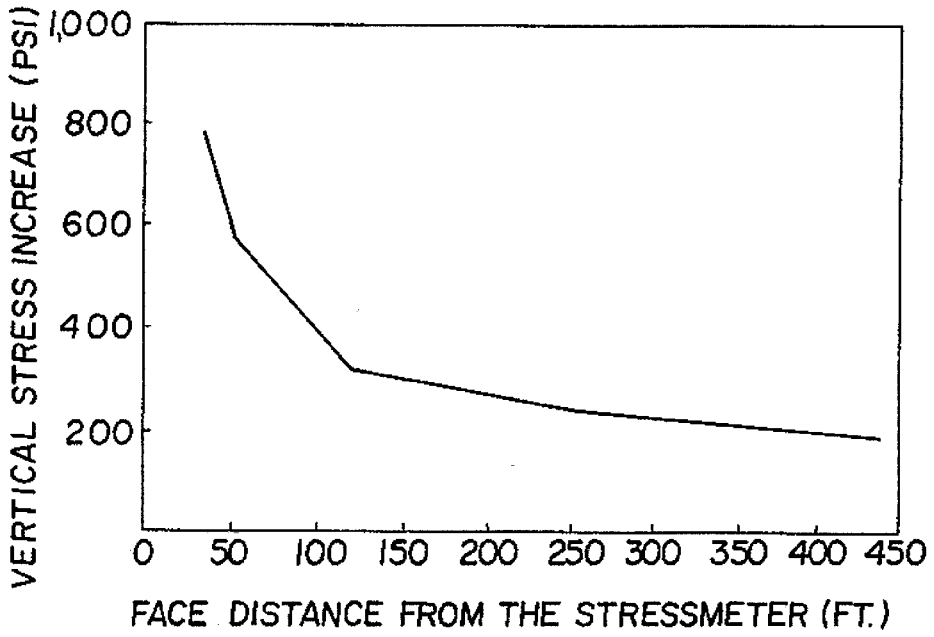
FIG. 15 is a graphic illustration of the load exerted on the rock strata measured by stressmeters located at selected distances from the longwall panel face.

In actual measurements, the instrumentation data indicated that the load pressures applied to the longwall panel adjacent the recovery room and the pillars adjacent the recovery room between the chutes and entries increased as the longwall mining machine advanced the panel toward the termination line. This is graphically illustrated in FIG. 15. The load pressures remained substantially constant exerted by the overhead rock strata up to a point of about three hundred feet from the advancing face. A major increase in pressure was detected at a distance of about one hundred twenty feet from the face. A maximum increase in pressure of approximately 600 psi was detected approximately thirty feet from the face.

Figure 16:
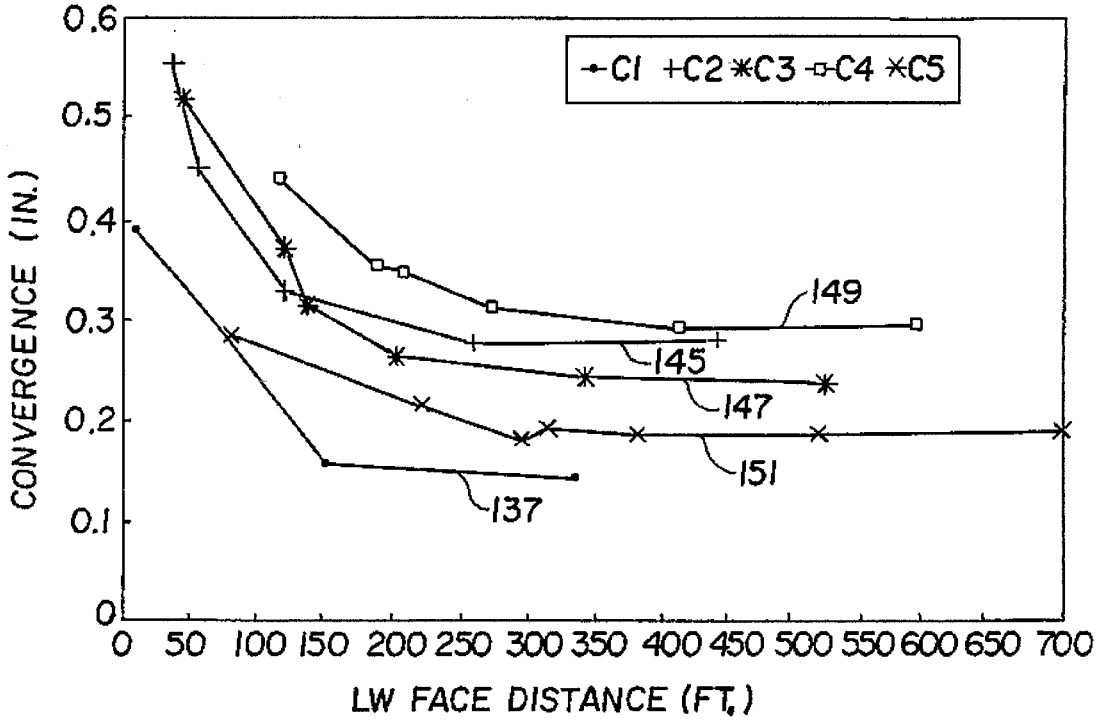
FIG. 16 is a graphic illustration, similar to FIG. 15, showing roof to floor convergence in relation to the distance of the recording instrument from the longwall panel face.

Referring to FIG. 16, there is graphically illustrated the data obtained at convergence stations 137, 145, 147, 149 and 151 as illustrated in FIG. 10. The data indicated that the roof to floor convergence reaches a maximum convergence of 0.55 inch occurring at approximately thirty feet from the advancing longwall face. Each of the convergence stations indicated the same pattern of a substantial increase in the roof to floor convergence at this distance.

Figure 17:
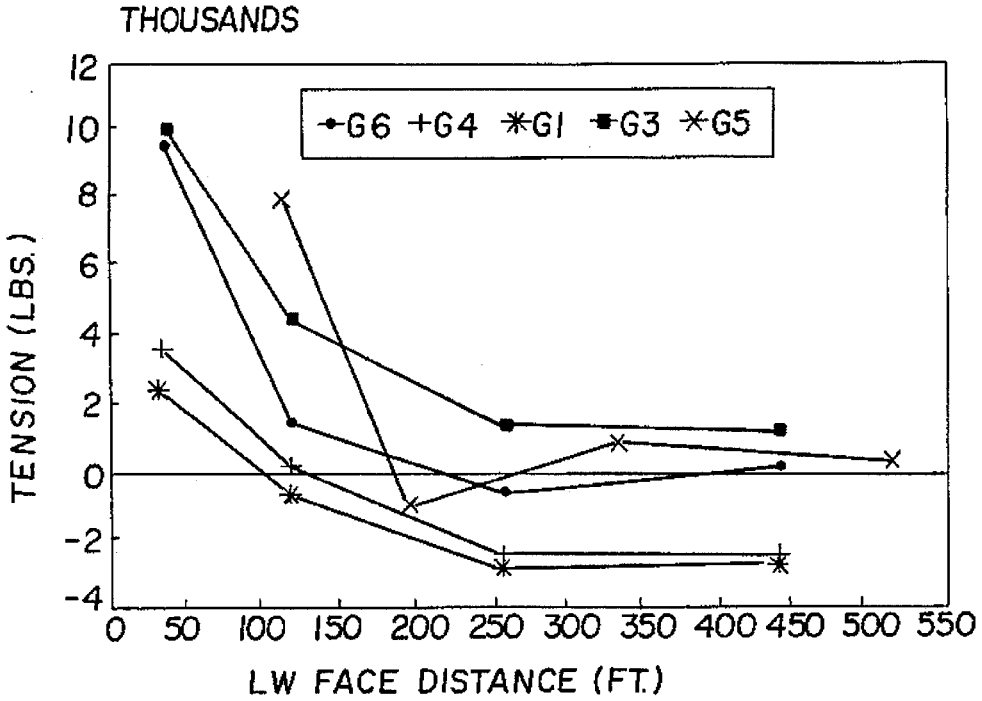
FIG. 17 is a graphic illustration of the tension measured by strain gages applied to tie rods of roof trusses and located at-selected distances from the longwall panel face.

Now referring to FIG. 17, there is illustrated graphically the results of the measurements taken by the strain gages mounted on the truss tie rods. The data indicates that the tension in the tie rods steadily increased at a point two hundred fifty feet from the panel face. The maximum increase in truss loading outby the face was 10,000 lbs. which occurred approximately thirty feet from the longwall face. The recorded tie rod tensions included the installed tension in the tie rod. All the roof truss systems were installed with a torque of 225 ft./lbs. applied to the tie rods. With anti-friction washers utilized on the torquing bolt, this provides a torque of 15,750 lbs. of installed load.

The load cells 139 installed in the roof showed no signs of change outby the longwall face. The roof load cells visually indicated signs of loading when the face line and tailgate shield were outby their location. Overall, the data collected from the instrumentation plan indicated that the primary and secondary roof support systems installed in the recovery room as well as the adjacent headgate and tailgate entries controlled the abutment pressures. Roof to floor convergence was minimal with no change detected in roof strata fracture patterns. The stress meter readings indicated that the magnitude and location of the maximum abutment pressure occurred at approximately thirty feet from the longwall face and indicated a reading of 1,675 psi. The maximum increase in truss tie rod loading was 25,750 lbs., providing a 35% safety factor as a function of average steel yield strength.

By providing the primary roof support system supplemented by the secondary roof support system, the mine roof above the excavated area behind the shields would "hang up" approximately a distance of sixteen to twenty feet behind the shields before the roof would finally collapse. Also, the instrumentation plan indicated no adverse roof conditions at the panel corner near the tailgate shield or outby in the tailgate entry.

The data collected from the instrumentation plan substantiated that the roof support system of the present invention provided appropriate control of the abutment pressure without the use of cribbing.

The support system for the headgate entry 20 shown in FIG. 11 is similar to that utilized in the recovery room 106 and recovery chute 36 illustrated in FIGS. 7 and 9. In FIG. 11, a portion of the headgate entry 20 is shown at an intersection with a bleeder entry 26. As with a recovery room or a recovery chute, the overhead strata above the headgate entry is supported by a primary system of roof bolt assemblies 126 installed in accordance with a roof bolt plan where rows of the assemblies 126 are positioned a preselected distance apart. The assemblies 126 are coordinated with the spacing of roof bolt assemblies 128 installed in the bleeder entry 26.

Supplementing the roof bolt assemblies 126 are roof truss assemblies 130 corresponding in construction to the truss assemblies installed in the recovery room 106 as shown in FIG. 7 and in the recovery chute 36 as shown in FIG. 9. The roof truss assemblies 130 traverse the width of the headgate 20, which in one example is about eighteen feet wide. The assemblies 130 are spaced a preselected distance apart and are installed the full length of the headgate entry 20. The ends of the truss assemblies 130 are anchored by roof bolts 132, as above described, to the solid rock strata above sidewalls 134 and 136. The sidewall 134 defines the longitudinal sidewall of the panel 12 which is progressively extracted. The sidewall 136, however, remains in place.

As the panel 12 is progressively removed, the sidewall 134 is also removed. However, the roof bolts 132 extend a sufficient depth into the rock strata so that they remain anchored as the roof behind the shield supports 50 is allowed to collapse. In this manner, the roof above the headgate entry 20 remains in place to permit continued use of the headgate entry 20 as the panel 12 is extracted. The combination of the rows of bolt assemblies 126 positioned in alignment with the roof truss assemblies 130 reinforces not only the strata above the roof of the headgate entry but the strata over the adjacent sidewalls 134 and 136 as well. Consequently, as the panel 12 is extracted, the roof above the headgate entry 20 remains safely in place.

The roof support plan for the headgate entry 20 is also repeated in the bleeder entry 26 so that the compressive forces applied to the overhead strata by the roof bolt assemblies 126 and the roof truss assemblies 130 are equally distributed throughout the strata. This prevents a concentration of compressive forces applied to the overhead strata which could contribute to a roof fall.

The above-described roof support plan for the headgate entry 20 can also be used in the tailgate entry 18. In addition, an alternate plan can be used in either the headgate or tailgate entries as illustrated for the tailgate entry 18 shown in FIG. 12 in which like numerals are used to designate like elements described above and illustrated in FIG. 11. In addition to the roof truss assemblies 130, roof channels 138 are installed in spaced parallel relation to one another. The roof channels 138 are spaced a preselected distance apart and equally spaced from adjacent roof truss assemblies.

The roof channels 138 are compressed against the roof above the tailgate entry 18 by a plurality of roof bolt assemblies 140 anchored a preselected depth into the overhead strata. Preferably, the roof bolt assemblies 140 utilize mechanically and resin anchored roof bolts in a length of about eight feet. Once anchored in the roof strata, the bolts are tensioned so that the bearing plates retained on the ends of the bolts are compressed against the channel members 138.

Again, the roof control system used in the tailgate entry 18 is repeated in the bleeder entry 26 to provide complementary roof support systems that interact with one another to securely support the overhead strata. Depending on the condition of the overhead strata, it may be necessary to use additional support systems described above. In addition, there may be occasions when supplemental support in the form of conventional cribbing 142 is utilized in the bleeder entry 26 as shown in FIG. 12. Thus, in accordance with the present invention, roof control systems are provided which serve to retain the rock strata above the tailgate and headgate entries 18 and 20 securely in place as the longwall panel 12 is progressively extracted.

With the present invention in a longwall mining operation, the panel face is continuously dislodged by the transversing movement of the shearers from the set-up room to the recovery room without encountering delays due to a roof fall immediately forward of the advancing shield supports. The advancing face and roof forward of the shield supports remains intact throughout the mine material dislodging operation. The longwall shearers cut into the recovery room without encountering roof control problems. The recovery room and recovery chutes remain intact, enabling quick teardown of the mining equipment in the recovery room and its movement through the recovery chutes to the next panel for setup.

The teardown operation in the reinforced recovery room is performed substantially free of the risk of a roof fall. The personnel are securely protected by a comprehensive roof support system in accordance with the present invention. The use of cribbing and wire screening used in conventional recovery operations can be eliminated with the roof control system of the present invention. This permits the longwall mining operation to be completed in a shorter period of time which substantially improves the cost effectiveness of the mining operation.

According to the provisions of the patent statutes, we have explained the principal, preferred construction and mode of operation of our invention and have illustrated and described what we now consider to represent its best embodiments. However, it should be understood that within the scope of the appended claims, the invention may be practiced otherwise than as specifically illustrated and described.

We claim:

1. Apparatus for measuring the effectiveness of roof support devices installed in an excavated area beneath underground rock strata comprising, a primary system of roof bolt assemblies installed in the rock strata above the roof in accordance with a preselected roof bolt pattern extending between opposed sidewalls of the excavated area, a secondary system of roof truss assemblies extending between the opposed sidewalls, each of said roof truss assemblies positioned in spaced parallel relation a preselected distance apart and in a selected position with respect to said roof bolt assemblies, anchor means extending upwardly at an angle through said roof into the rock strata above the opposed sidewalls for securing said roof truss assemblies to the rock strata to place said roof truss assembly in tension and support the rock strata above the roof, a plurality of spaced apart longitudinally extending channel members positioned between and parallel to the opposed sidewalls, a plurality of longitudinally extending channel members anchored to the roof in parallel relation between the opposed sidewalls to supplement the roof support provided by the combination of said primary system of roof bolt assemblies and said secondary system of roof truss assemblies, and instrumentation means installed in the rock strata surrounding the excavated area and connected to said primary system of roof bolt assemblies and said secondary system of roof truss assemblies for measuring the forces exerted by the rock strata on said primary and secondary systems to determine the operability of said systems to support the rock strata.

2. A method for maintaining the operability of a roof support system installed to support overhead rock strata in a longwall recovery room comprising the steps of, initially forming a recovery room of a preselected width extending from a termination line of a longwall panel of mine material to an outby wall, installing roof support devices in rock strata above a roof of the recovery room, expanding the width of the recovery room from the outby wall a preselected distance, installing roof support devices in the rock strata above a roof of the expanded area of the recovery room coordinated with the roof support devices installed in the initial area of the recovery room to form an enlarged recovery room having a reinforced overhead rock strata, installing load sensing instruments in the rock strata surrounding the recovery room and in contact with the roof support devices to measure the forces applied by the rock strata surrounding the recovery room and the load exerted on the roof support devices, and monitoring the load sensing instruments to determine the effectiveness of the roof support devices to reinforce the rock strata surrounding the recovery room.

3. A method for extracting a panel of mine material by a longwall mining operation comprising the steps of, cutting a longwall panel in a seam of mine material extending a preselected length into rock strata and extending in width between a headgate entry and a tailgate entry, forming at one transverse end of the panel a set-up room defining a full face of the panel for initiating the extraction of mine material from the face, installing support systems for reinforcing the rock strata above a roof formed in the headgate entry, the tailgate entry and the set-up room, forming at the opposite transverse end of the panel a recovery room extending in length between the headgate and tailgate entries, initially extending the width of the recovery room a preselected distance from a termination line of the panel to an opposite first sidewall of the rock strata, installing a first support system for reinforcing the rock strata above a roof of the recovery room extending between the panel termination and the first sidewall, extending the first support system into the rock strata above the panel termination line to reinforce the rock strata above the termination line, extracting the first sidewall after installing the first support system in the recovery room to expand the width of the recovery room a preselected distance to a second sidewall to form a resultant recovery room of expanded width, installing a second support system for reinforcing the rock strata above the roof of the expanded width of the recovery room, extending the second support system into the area of the recovery room roof supported by the first support system to reinforce the mid span of the recovery room roof between the panel termination line and the second sidewall, installing load sensing devices in boreholes drilled in the rock strata surrounding the headgate entry, the tailgate entry, the set-up room and the recovery room, installing load sensing devices in contact with the support systems including the first and second support systems, transversing a longwall shearer back and forth across the panel face to extract mine material from the panel and advance the panel face to the panel termination line, and monitoring the load sensing devices to obtain a reading of the forces applied thereto by the rock strata to determine the effectiveness of the roof support systems to support the rock strata as the longwall shearer advances through the panel termination line into the recovery room.

4. Apparatus for supporting rock strata above a tailgate entry and a headgate entry defining a panel of material for extraction by a longwall mining operation comprising, a primary system of roof bolt assemblies installed in accordance with a preselected bolt pattern in the rock strata above the tailgate and headgate entries, said bolt pattern including a plurality of rows of roof bolts with each row having roof bolts anchored in the rock strata and spaced a preselected distance apart between opposing sidewalls of the tailgate and headgate entries, said rows of roof bolts spaced a preselected distance apart the length of the tailgate and headgate entries, load sensing devices installed in the rock strata surrounding the tailgate and headgate entries to monitor the effectiveness of said primary system to support the surrounding rock strata, a supplemental system of roof truss assemblies extending between opposing sidewalls of the entry, each of said roof truss assemblies positioned in spaced parallel relation a preselected distance apart and in a selected position with respect to said roof bolt assemblies, said roof truss assemblies each including opposite end portions positioned closely adjacent to the opposing sidewalls, anchor means for securing said roof truss assembly opposite end portions to said rock strata, said anchor means extending upwardly at an angle through said rock strata above the opposing sidewalls to place said roof truss assembly in tension and support the overhead rock strata, instrument means connected to said roof truss assemblies for measuring the truss loading of the overhead rock strata, and said load sensing device and said instrument means providing a readout of abutment pressures exerted upon the rock strata as the panel of material is extracted.

* * * * *